US009343247B2

(12) United States Patent
Hsu

(10) Patent No.: US 9,343,247 B2
(45) Date of Patent: May 17, 2016

(54) KEYSWITCH

(71) Applicant: DARFON ELECTRONICS CORP., Taoyuan (TW)

(72) Inventor: Chien-Shih Hsu, Taoyuan (TW)

(73) Assignee: DARFON ELECTRONICS CORP., Gueishan, Taoyuan (TW)

( * ) Notice: Subject to any disclaimer, the term of this patent is extended or adjusted under 35 U.S.C. 154(b) by 0 days.

(21) Appl. No.: 14/711,784

(22) Filed: May 14, 2015

(65) Prior Publication Data

US 2015/0243456 A1 Aug. 27, 2015

Related U.S. Application Data

(63) Continuation-in-part of application No. 13/541,655, filed on Jul. 3, 2012, now Pat. No. 9,064,651.

(30) Foreign Application Priority Data

Nov. 17, 2011 (TW) ..... 100142162 A

(51) Int. Cl.
*H01H 9/00* (2006.01)
*H01H 13/20* (2006.01)
(Continued)

(52) U.S. Cl.
CPC ..... *H01H 13/20* (2013.01); *H01H 13/02* (2013.01); *H01H 13/7065* (2013.01); *H01H 3/12* (2013.01); *H01H 13/06* (2013.01); *H01H 13/22* (2013.01); *H01H 13/702* (2013.01); *H01H 2221/04* (2013.01); *H01H 2221/09* (2013.01)

(58) Field of Classification Search
CPC ... H01H 13/14; H01H 13/7065; H01H 3/125; H01H 11/04; H01H 2203/038; H01H 2215/042; H01H 2221/04; H01H 2221/09; H01H 2227/032; H01H 36/0073; H01H 36/0033; H01H 36/02; H01H 36/004; H01H 2003/506; H01H 9/443; H01H 13/186; H01H 33/18; H01H 9/02; H01F 7/02
USPC ..... 335/205
See application file for complete search history.

(56) References Cited

U.S. PATENT DOCUMENTS 3,644,856 A 2/1972 Scott
4,296,394 A 10/1981 Ragheb
(Continued)

FOREIGN PATENT DOCUMENTS

CN 101409166 A 4/2009
CN 201741607 U 2/2011
(Continued)

*Primary Examiner* — Shawki S Ismail
*Assistant Examiner* — Lisa N Homza
(74) *Attorney, Agent, or Firm* — Winston Hsu; Scott Margo

(57) ABSTRACT

A keyswitch includes a casing having a first magnetic area, a key cap, and a support device including first and second support members rotatably connected to the key cap and the base plate. The first support member has a receiving opening and a second magnetic area disposed within the receiving opening. When the key cap is not pressed, a magnetic attraction force between the first and second magnetic areas keeps the key cap at a non-pressed position. When the key cap is pressed by an external force, the key cap moves with the support device toward a pressed position. When the external force is removed, the second magnetic area moves toward the first magnetic area due to the magnetic attraction force such that the key cap moves with the support device from the pressed position toward the non-pressed position.

6 Claims, 31 Drawing Sheets

(51) Int. Cl.

| | |
|---|---|
| ***H01H 13/7065*** | (2006.01) |
| ***H01H 13/02*** | (2006.01) |
| *H01H 3/12* | (2006.01) |
| *H01H 13/06* | (2006.01) |
| *H01H 13/22* | (2006.01) |
| *H01H 13/702* | (2006.01) |

(56) References Cited

U.S. PATENT DOCUMENTS

| | | | | |
|---|---|---|---|---|
| 4,402,131 | A * | 9/1983 | Roberts | H01H 1/403 200/283 |
| 4,453,148 | A | 6/1984 | Norakidze | |
| 4,689,608 | A | 8/1987 | Bolda | |
| 5,268,545 | A | 12/1993 | Bruner | |
| 5,769,210 | A | 6/1998 | Tsai | |
| 5,813,521 | A | 9/1998 | Koike | |
| 6,060,676 | A | 5/2000 | Pan | |
| 6,118,092 | A | 9/2000 | Hayashi | |
| 6,392,515 | B1 | 5/2002 | Van Zeeland | |
| 6,531,667 | B2 | 3/2003 | Becker | |
| 6,556,112 | B1 | 4/2003 | Van Zeeland | |
| 6,635,838 | B1 | 10/2003 | Kornelson | |
| 6,670,873 | B2 | 12/2003 | Inada | |
| 6,677,843 | B1 * | 1/2004 | Monroe | H01H 13/705 200/512 |
| 6,706,985 | B2 | 3/2004 | Chun | |
| 6,723,935 | B1 | 4/2004 | Watanabe | |
| 6,759,933 | B2 | 7/2004 | Fallak | |
| 6,761,494 | B2 | 7/2004 | Hsu | |
| 6,812,421 | B2 | 11/2004 | Sato | |
| 6,936,782 | B2 | 8/2005 | Ito | |
| 6,972,385 | B2 | 12/2005 | Krebs | |
| 7,022,929 | B1 | 4/2006 | Snider | |
| 7,312,414 | B2 | 12/2007 | Yatsu | |
| 7,319,202 | B2 | 1/2008 | Sato | |
| 7,449,651 | B2 | 11/2008 | Lin | |
| 7,595,712 | B2 | 9/2009 | Nishino | |
| 7,642,886 | B2 | 1/2010 | Boss | |
| 7,683,280 | B2 * | 3/2010 | Hsu | H01H 3/125 200/344 |
| 7,728,242 | B2 | 6/2010 | Huang | |
| 7,882,609 | B2 * | 2/2011 | Hsu | B21D 39/00 200/344 |
| 7,954,222 | B2 | 6/2011 | Hsu | |
| 8,629,362 | B1 * | 1/2014 | Knighton | H01H 13/52 200/344 |
| 2003/0224737 | A1 | 12/2003 | Yokoji | |
| 2005/0123333 | A1 | 6/2005 | Sugimura | |
| 2006/0257190 | A1 | 11/2006 | Chiang | |
| 2006/0267962 | A1 | 11/2006 | Baier | |
| 2007/0181410 | A1 | 8/2007 | Baier | |
| 2008/0237012 | A1 | 10/2008 | Koike | |
| 2012/0169603 | A1 | 7/2012 | Peterson | |
| 2012/0313738 | A1 | 12/2012 | Chang | |
| 2013/0233685 | A1 | 9/2013 | Zhang | |
| 2014/0034471 | A1 * | 2/2014 | Krumpelman | H01H 13/85 200/5 A |

FOREIGN PATENT DOCUMENTS

| | | | |
|---|---|---|---|
| CN | 102623224 | A | 8/2012 |
| CN | 103065842 | A | 4/2013 |
| CN | 103123871 | A | 5/2013 |
| CN | 104051175 | A | 9/2014 |
| EP | 0 189 132 | A2 | 7/1986 |
| EP | 0 189 132 | A3 | 7/1986 |
| JP | 2006260866 | A | 9/2006 |
| TW | 201434064 | A | 9/2014 |
| WO | 2007114631 | A2 | 10/2007 |
| WO | 2007114631 | A3 | 10/2007 |

* cited by examiner

KEYSWITCH

CROSS REFERENCE TO RELATED APPLICATIONS

This application is a continuation in part of U.S. application Ser. No. 13/541,655 filed on Jul. 3, 2012.

BACKGROUND OF THE INVENTION

1. Field of the Invention

The invention relates to a keyswitch and, more particularly, to a keyswitch utilizing a magnetic attraction force to drive a key cap to move with a support device between a non-pressed position and a pressed position.

2. Description of the Prior Art

A keyboard, which is the most common input device, can be found in variety of electronic equipments for users to input characters, symbols, numerals and so on. From consumer electronic products to industrial machine tools are all equipped with a keyboard for purpose of operation.

Referring to FIG. 1, FIG. 1 is a cross-sectional view illustrating a keyswitch 1 of the prior art. As shown in FIG. 1, the keyswitch 1 comprises a base 10, a key cap 12, a circuit board 14, a support device 16 and a resilient member 18. The circuit board 14 is disposed on the base 10. The support device 16 is disposed between the key cap 12 and the base 10 and used for supporting the key cap 12. The resilient member 18 is also disposed between the key cap 12 and the base 10. After the key cap 12 is pressed by a user, the resilient member 18 provides an elastic force for the key cap 12 so as to make the key cap 12 returns to the original position. The resilient member 18 is usually made of rubber and rubber may get fatigue after being used for a long time such that the lifetime of the keyswitch 1 may be reduced.

SUMMARY OF THE INVENTION

Therefore, an objective of the invention is to provide a keyswitch utilizing a magnetic attraction force to drive a key cap to move with a support device between a non-pressed position and a pressed position.

According to another embodiment of the invention, a keyswitch includes a base plate, a key cap, and a support device. The base plate has a first magnetic area. The support device is disposed between the base plate and the key cap. The support device includes a first support member and a second support member. The first support member and the second support member are rotatably connected to the key cap and the base plate such that the key cap moves with the support device between a non-pressed position and a pressed position. The first support member has a receiving opening and a second magnetic area corresponding to the first magnetic area. The second magnetic area is disposed within the receiving opening. When the key cap is not pressed, a magnetic attraction force between the first magnetic area and the second magnetic area keeps the key cap at the non-pressed position. When the key cap is pressed by an external force such that the second magnetic area moves away from the first magnetic area with rotation of the first support member, the key cap moves with the support device from the non-pressed position toward the pressed position. When the external force is removed, the second magnetic area moves toward the first magnetic area due to the magnetic attraction force such that the key cap moves with the support device from the pressed position toward the non-pressed position.

As mentioned in the above, the first magnetic area of the invention is selectively disposed on one of the casing, which may be the base plate or a combination of the base plate and the frame, and the key cap, and the support device has the second magnetic area corresponding to the first magnetic area. When the key cap is not pressed, the magnetic attraction force between the first magnetic area and the second magnetic area keeps the key cap at the non-pressed position. When the key cap is pressed by the external force such that the second magnetic area moves away from the first magnetic area, the key cap moves with the support device from the non-pressed position toward the pressed position. When the external force is removed, the second magnetic area moves toward the first magnetic area due to the magnetic attraction force such that the key cap moves with the support device from the pressed position toward the non-pressed position. Since the resilient member of the conventional keyswitch is unnecessary for the invention, the lifetime of the keyswitch of the invention can be extended effectively.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
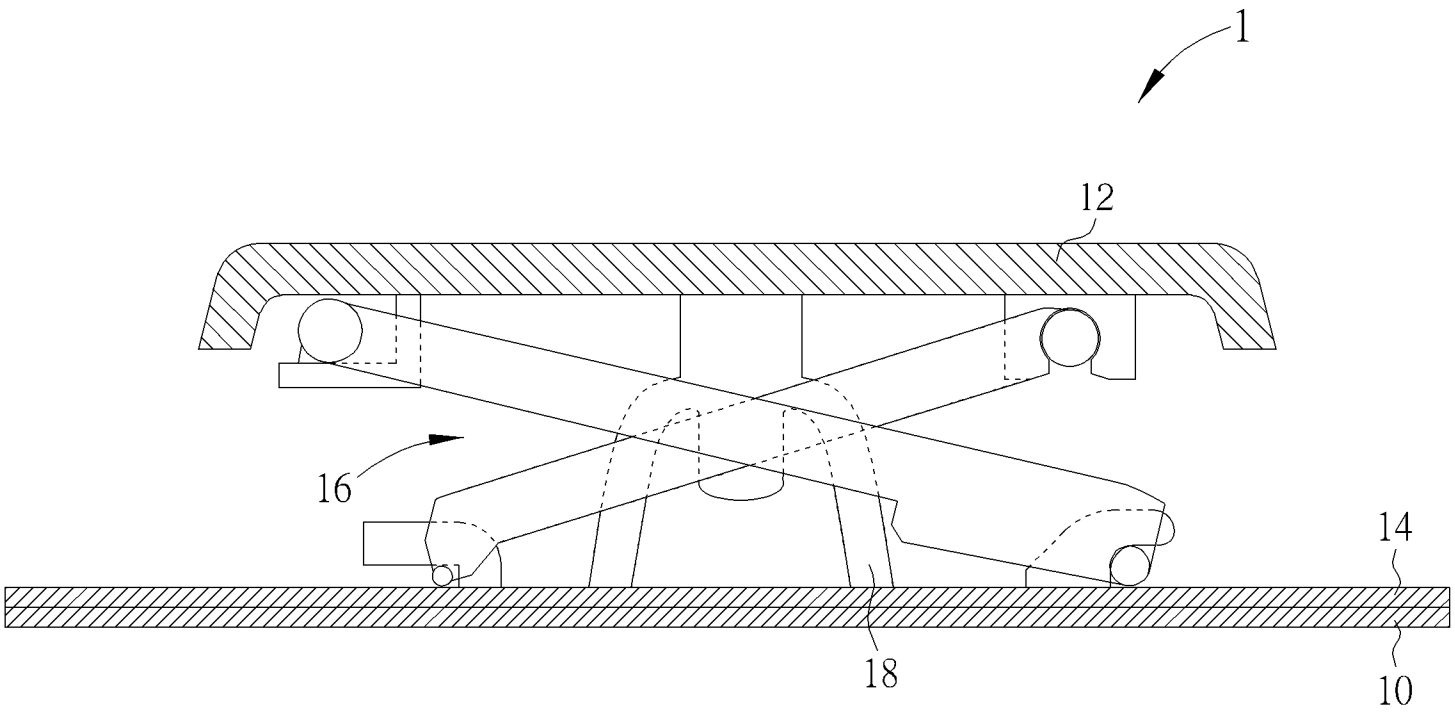
FIG. 1 PRIOR ART
FIG. 1 is a cross-sectional view illustrating a keyswitch of the prior art.
Figure 2:
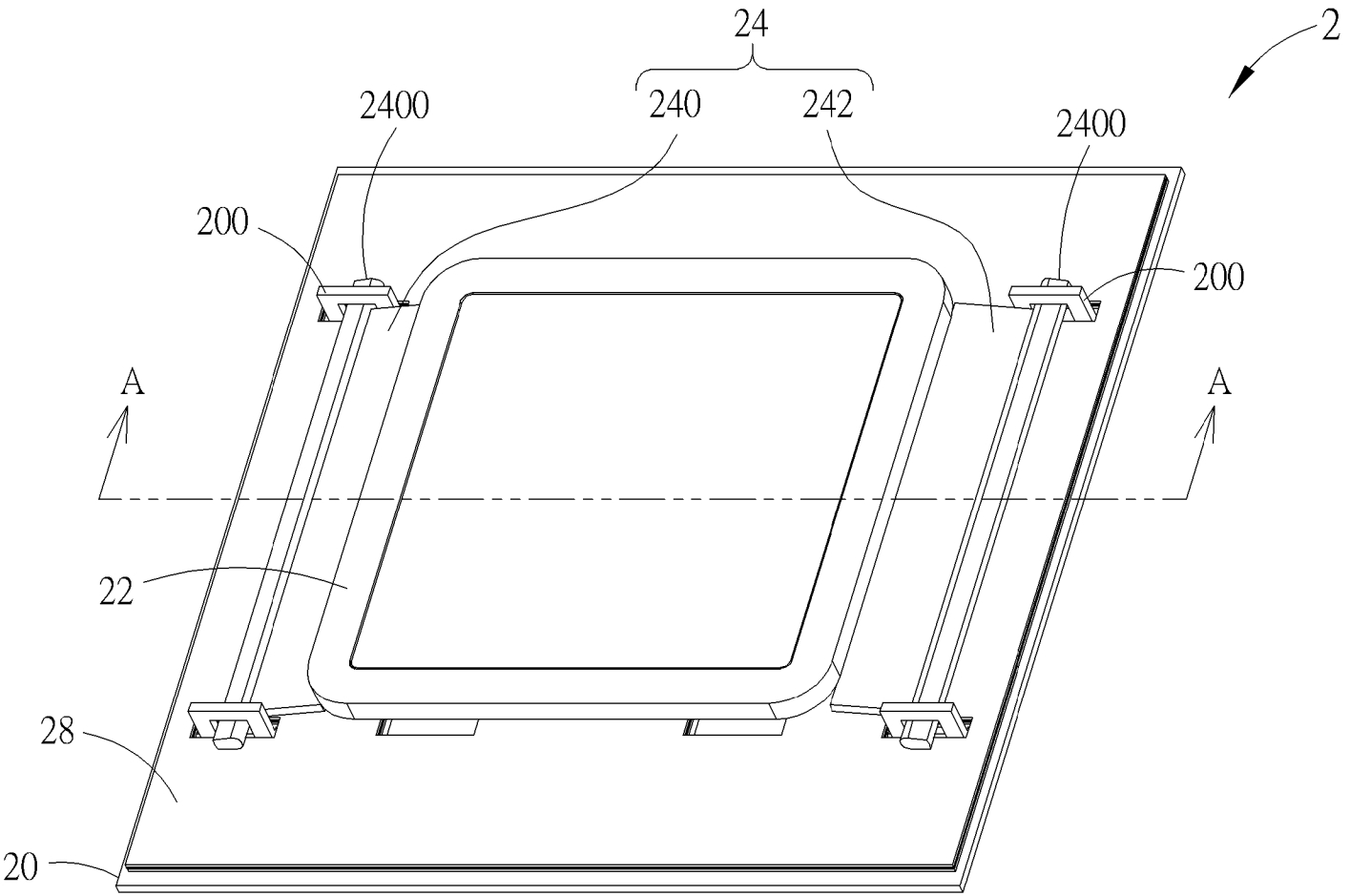
FIG. 2 is a perspective view illustrating a keyswitch according to an embodiment of the invention.
Figure 3:
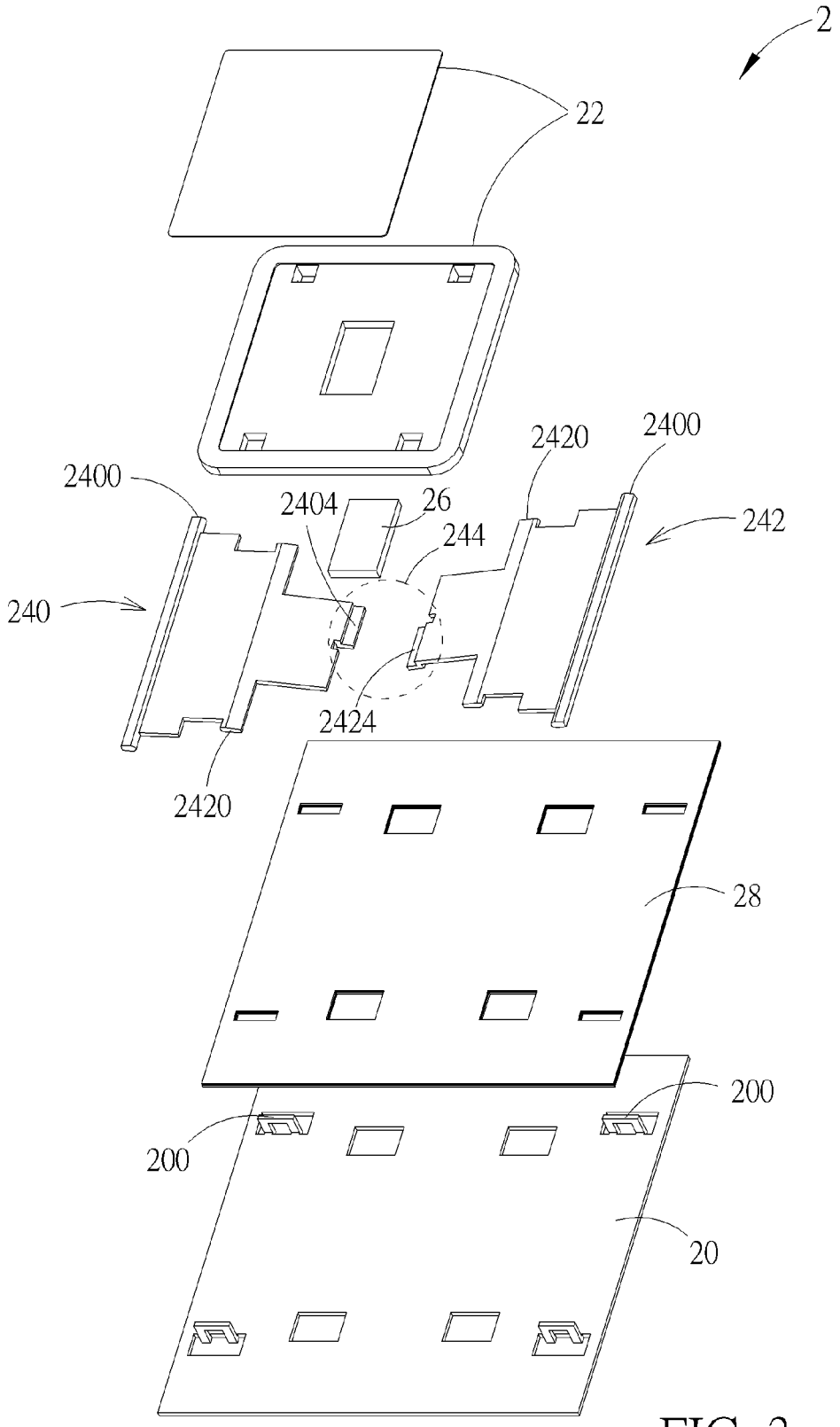
FIG. 3 is an exploded view illustrating the keyswitch shown in FIG. 2.
Figure 4:
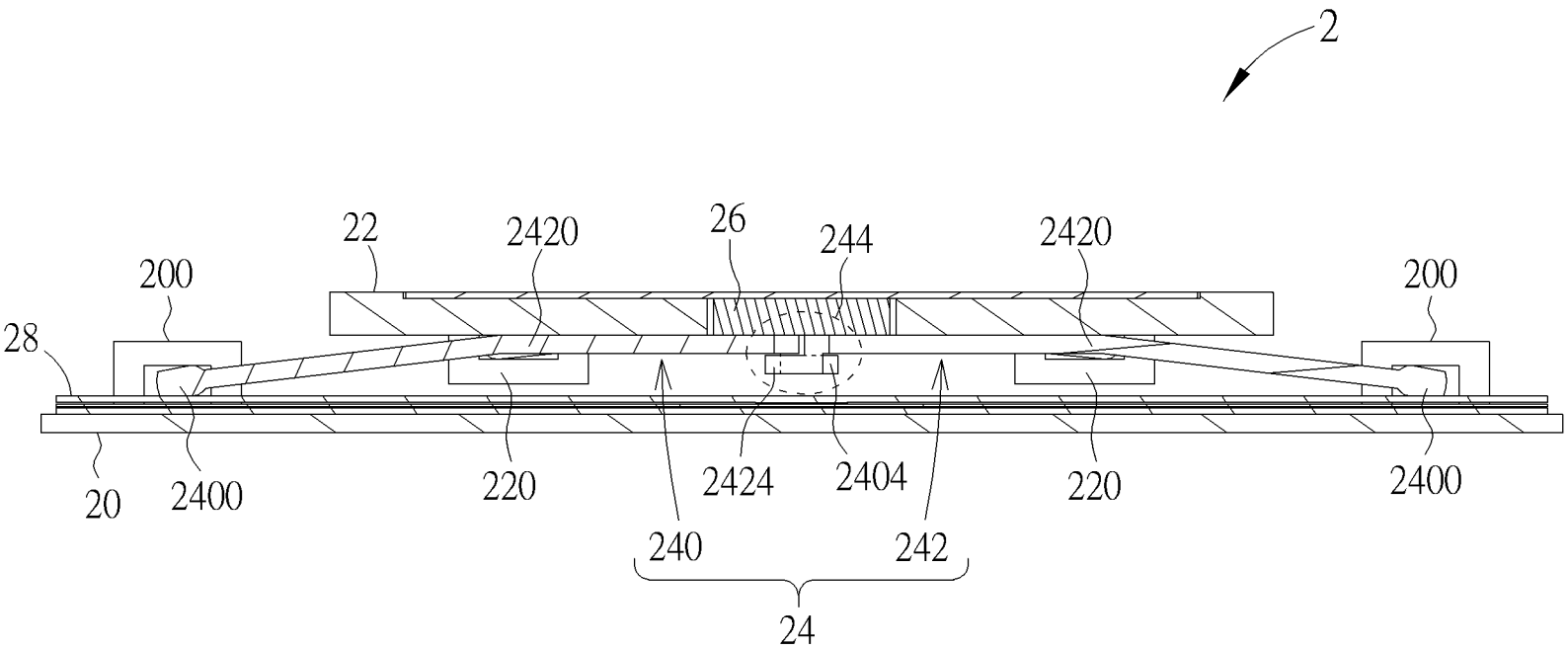
FIG. 4 is a cross-sectional view illustrating the keyswitch along line A-A shown in FIG. 2.
Figure 5:
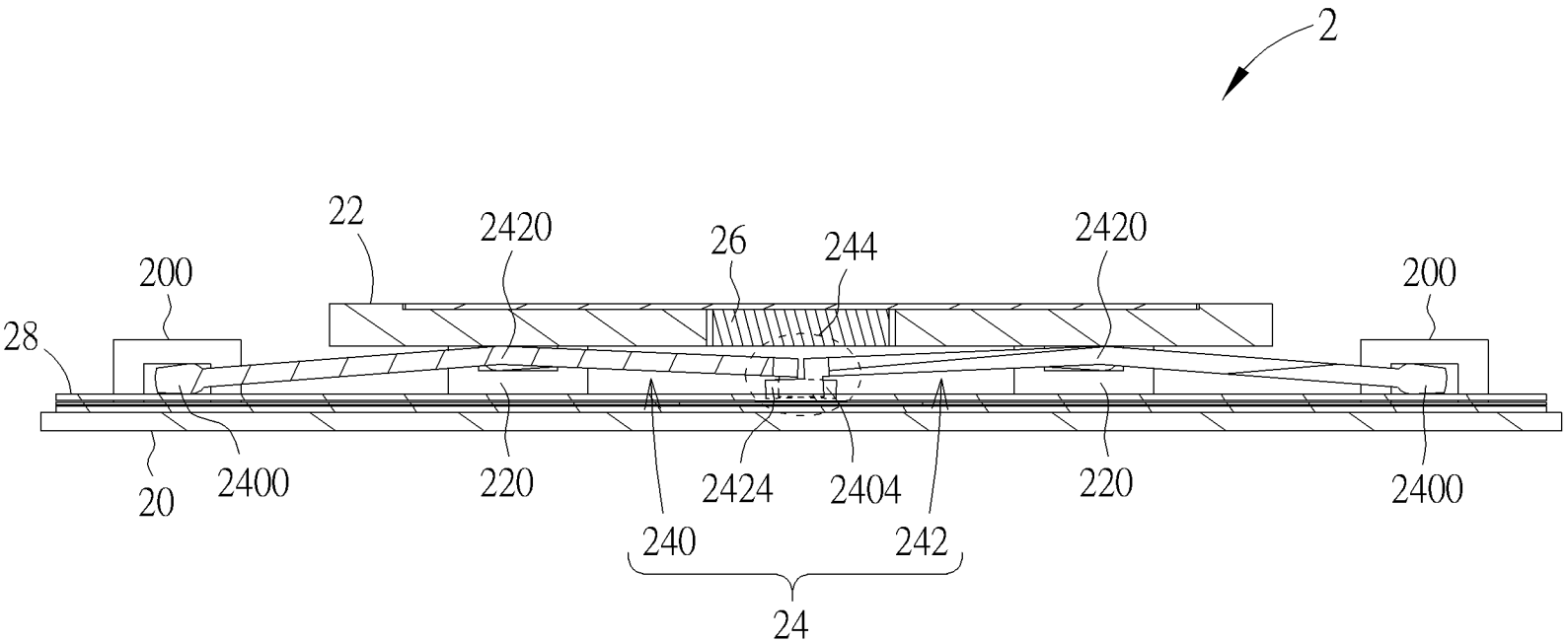
FIG. 5 is a cross-sectional view illustrating the key cap shown in FIG. 4 being pressed.

Referring to FIGS. 2 to 5, FIG. 2 is a perspective view illustrating a keyswitch 2 according to an embodiment of the invention, FIG. 3 is an exploded view illustrating the keyswitch 2 shown in FIG. 2, FIG. 4 is a cross-sectional view illustrating the keyswitch 2 along line A-A shown in FIG. 2, and FIG. 5 is a cross-sectional view illustrating the key cap 22 shown in FIG. 4 being pressed. As shown in FIGS. 2 to 5, the keyswitch 2 comprises a base 20, a key cap 22, a support device 24 and a circuit board 28. In this embodiment, the base 20 is a casing of the keyswitch 2. In practical applications, the circuit board 28 may be, but not limited to, a membrane circuit board.

The support device 24 is disposed between the base 20 and the key cap 22 and rotatably connected to the key cap 22 and the base 20. In this embodiment, the support device 24 may comprise a first support member 240 and a second support member 242. Each of the first support member 240 and the second support member 242 comprises a first connecting portion (i.e. a first end portion) 2400 and a second connecting portion (i.e. a central portion) 2420, wherein the first connecting portion 2400 is rotatably connected to the base 20 and the second connecting portion 2420 is rotatably connected to the key cap 22. In this embodiment, the first connecting portion 2400 is rotatably connected to a connecting socket 200 of the base 20 and the second connecting portion 2420 is rotatably connected to a connecting socket 220 of the key cap 22, but the invention is not limited to this embodiment. In other words, the first connecting portion 2400 is confined in the connecting socket 200 such that the first end portion is rotatably connected to the base 20. Accordingly, the key cap 22 can move with the support device 24 between a non-pressed position (as shown in FIG. 4) and a pressed position (as shown in FIG. 5). Furthermore, the first support member 240 has a first linking portion 2404 and the second support member 242 has a second linking portion 2424. The first linking portion 2404 abuts against the second member 242 and the second linking portion 2424 abuts against the first support member 240 such that the first support member 240 and the second support member 242 can rotate simultaneously when the key cap 22 is pressed or the external force is removed.

The key cap 22 has a first magnetic area 26 and the support device 24 has a second magnetic area (i.e. a second end portion) 244 corresponding to the first magnetic area 26. One of the first magnetic area 26 and the second magnetic area 244 may be a magnetic object (e.g. magnet) and the other one of the first magnetic area 26 and the second magnetic area 244 may be a magnetic object (e.g. magnet) or a magnetic induction material (e.g. iron or other metals). In this embodiment, the first magnetic area 26 may be a magnetic object and the second magnetic area 244 may be a magnetic induction material. In practical applications, the support device 24 may be made of magnetic induction material wholly. Furthermore, in another embodiment, the first magnetic area 26 and the second magnetic area 244 both may be magnets.

When the key cap 22 is not pressed, a magnetic attraction force between the first magnetic area 26 and the second magnetic area 244 keeps the key cap 22 at the non-pressed position (as shown in FIG. 4). When the key cap 22 is pressed by an external force, which can overcome the magnetic attraction force, such that the second magnetic area 244 moves away from the first magnetic area 26, the second magnetic area 244 pivots on the second connecting portion (i.e. the central portion) 2420 such that the key cap 22 moves with the support device 24 from the non-pressed position toward the pressed position (as shown in FIG. 5). When the external force is removed, the second magnetic area 244 moves toward the first magnetic area 26 due to the magnetic attraction force and the second magnetic area 244 drives the first support member 240 and the second support member 242 of the support device 24 to pivot on the second connecting portions (i.e. the central portion) 2420 such that the key cap 22 moves with the support device 24 from the pressed position toward the non-pressed position. As shown in FIG. 5, when the key cap 22 is pressed to the pressed position, the first linking portion 2404 of the first support member 240 and/or the second linking portion 2424 of the second support member 242 will trigger switches of the circuit board 28 so as to execute input function correspondingly.

As shown in FIG. 4, the first support member 240 is formed as a V-shaped structure, wherein the first support member 240 has a first end portion 2400 and a second end portion 244 and an angle included between the first end portion 2400 and the second end portion 244 is larger than 90 degrees.

Figure 6:
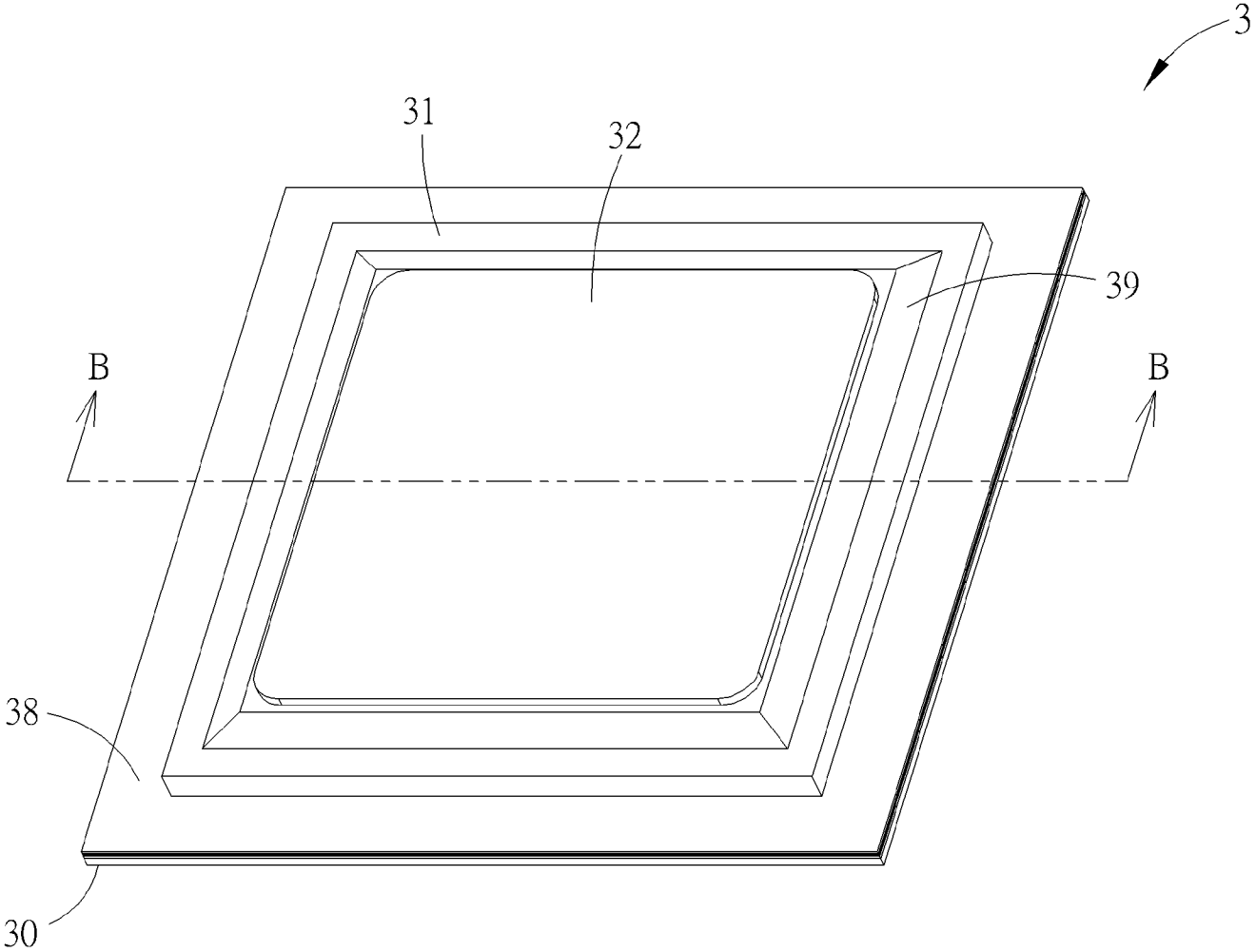
FIG. 6 is a perspective view illustrating a keyswitch according to another embodiment of the invention.
Figure 7:
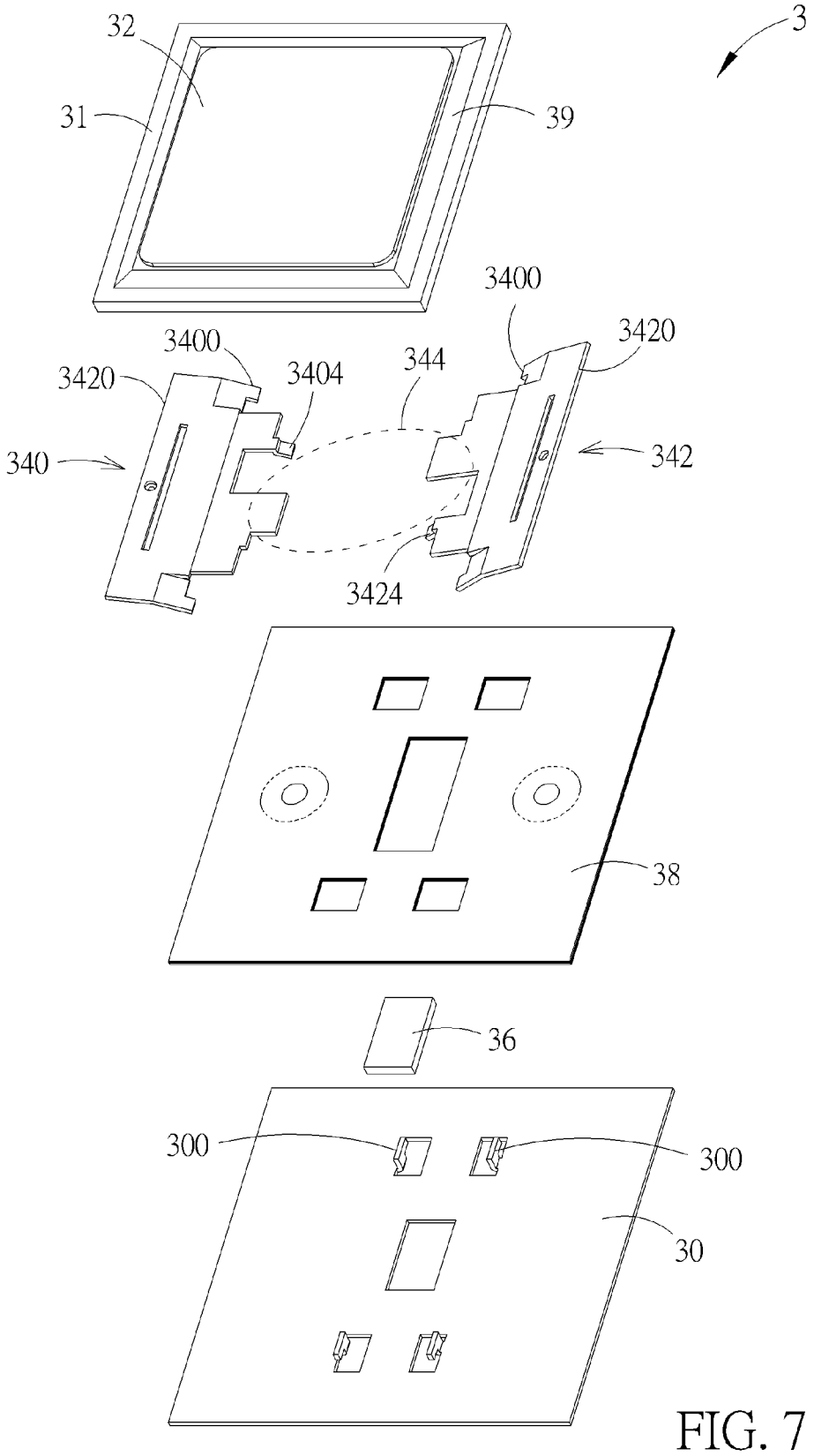
FIG. 7 is an exploded view illustrating the keyswitch shown in FIG. 6.
Figure 8:
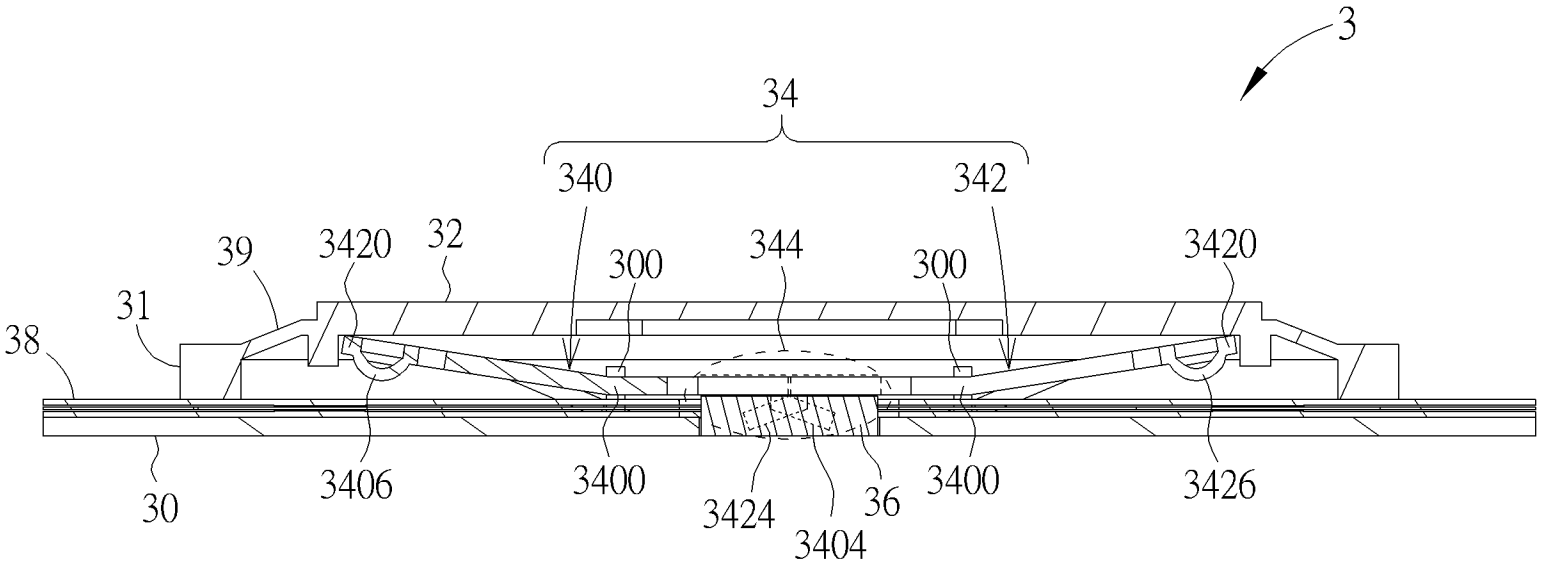
FIG. 8 is a cross-sectional view illustrating the keyswitch along line B-B shown in FIG. 6.
Figure 9:
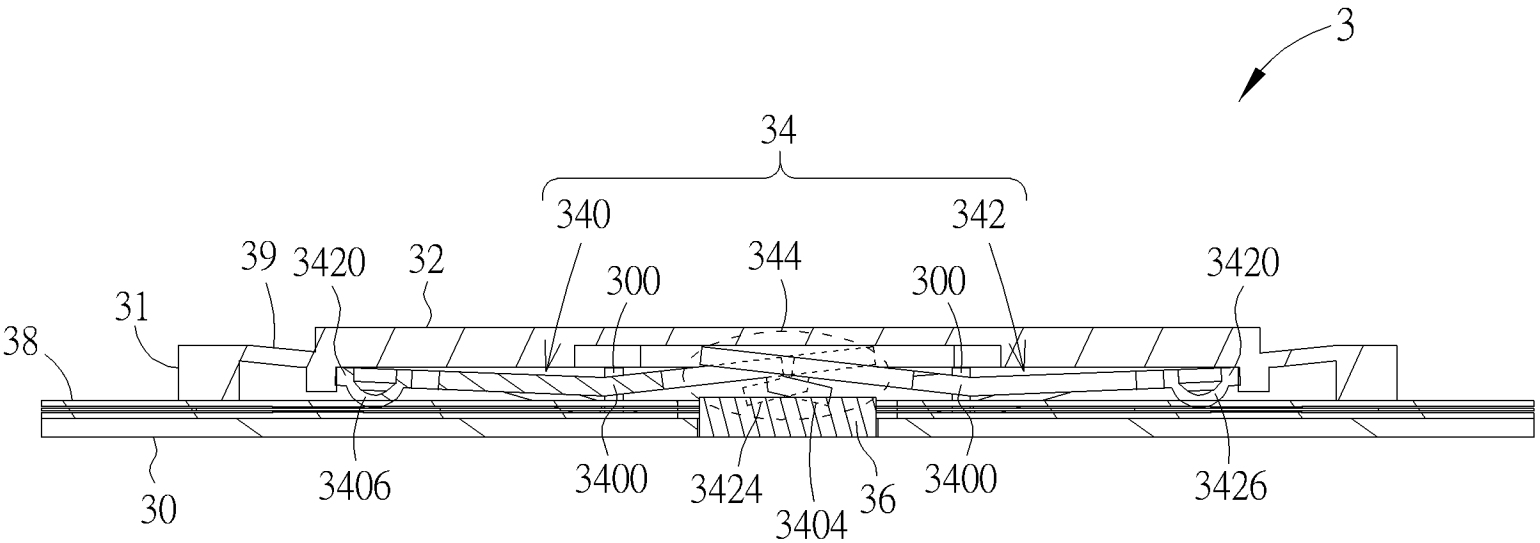
FIG. 9 is a cross-sectional view illustrating the key cap shown in FIG. 8 being pressed.

Referring to FIGS. 6 to 9, FIG. 6 is a perspective view illustrating a keyswitch 4 according to another embodiment of the invention, FIG. 7 is an exploded view illustrating the keyswitch 3 shown in FIG. 6, FIG. 8 is a cross-sectional view illustrating the keyswitch 3 along line B-B shown in FIG. 6, and FIG. 9 is a cross-sectional view illustrating the key cap 32 shown in FIG. 8 being pressed. As shown in FIGS. 6 to 9, the keyswitch 3 comprises a base 30, a frame 31, a key cap 32, a support device 34 and a circuit board 38. In this embodiment, the combination of the base 30 and the frame 31 is a casing of the keyswitch 3. In practical applications, the circuit board 38 may be, but not limited to, a membrane circuit board.

The frame 31 is disposed on the base 30 and the key cap 32 is disposed in the frame 31. In this embodiment, the key cap 32 may be connected to the frame 31 by a flexible material 39. The flexible material 39 surrounds the key cap 32 such that there is no gap between the key cap 32 and the frame 31. Accordingly, the flexible material 39 can prevent dust, beverage, water or other liquids from entering the space under the key cap 32. The support device 34 is disposed between the base 30 and the key cap 32 and rotatably connected to the key cap 32 and the base 30. In this embodiment, the support device 34 may comprise a first support member 340 and a second support member 342. Each of the first support member 340 and the second support member 342 comprises a first connecting portion (i.e. a central portion) 3400 and a second connecting portion (i.e. a first end portion) 3420, wherein the first connecting portion 3400 is rotatably connected to the base 30 and the second connecting portion 3420 is rotatably connected to the key cap 32. In this embodiment, the first connecting portion 3400 is rotatably connected to a connecting socket 300 of the base 30 and the second connecting portion 3420 abuts against the key cap 32 so as to be rotatably connected to the key cap 32, but the invention is not limited to this embodiment. In other words, the first connecting portion 3400 is confined in the connecting socket 300 such that the central portion is rotatably connected to the base 30. Accordingly, the key cap 32 can move with the support device 34 between a non-pressed position (as shown in FIG. 8) and a pressed position (as shown in FIG. 9). Furthermore, the first support member 340 has a first linking portion 3404 and the second support member 342 has a second linking portion 3424. The first linking portion 3404 abuts against the second member 342 and the second linking portion 3424 abuts against the first support member 340 such that the first support member 340 and the second support member 342 can rotate simultaneously when the key cap 32 is pressed or the external force is removed.

The base 30 has a first magnetic area 36 and the support device 34 has a second magnetic area (i.e. a second end portion) 344 corresponding to the first magnetic area 36. One of the first magnetic area 36 and the second magnetic area 344 may be a magnetic object (e.g. magnet) and the other one of the first magnetic area 36 and the second magnetic area 344 may be a magnetic object (e.g. magnet) or a magnetic induction material (e.g. iron or other metals). In this embodiment, the first magnetic area 36 may be a magnetic object and the second magnetic area 344 may be a magnetic induction material. In practical applications, the support device 34 may be made of magnetic induction material wholly. Furthermore, in another embodiment, the first magnetic area 36 and the second magnetic area 344 both may be magnets.

When the key cap 32 is not pressed, a magnetic attraction force between the first magnetic area 36 and the second magnetic area 344 keeps the key cap 32 at the non-pressed position (as shown in FIG. 8). When the key cap 32 is pressed by an external force, which can overcome the magnetic attraction force, such that the second magnetic area 344 moves away from the first magnetic area 36, the second magnetic area 344 pivots on the first connecting portion (i.e. the central portion) 3400 such that the key cap 32 moves with the support device 34 from the non-pressed position toward the pressed position (as shown in FIG. 9). When the external force is removed, the second magnetic area 344 moves toward the first magnetic area 36 due to the magnetic attraction force and the second magnetic area 344 drives the first support member 340 and the second support member 342 of the support device 34 to pivot on the first connecting portion (i.e. the central portion) 3400 such that the key cap 32 moves with the support device 34 from the pressed position toward the non-pressed position. As shown in FIG. 9, when the key cap 32 is pressed to the pressed position, a triggering portion 3406 of the first support member 340 and a triggering portion 3426 of the second support member 342 will trigger switches of the circuit board 38 so as to execute input function correspondingly.

As shown in FIG. 8, the first support member 340 is formed as a V-shaped structure, wherein the first support member 340 has a first end portion 3420 and a second end portion 344 and an angle included between the first end portion 3420 and the second end portion 344 is larger than 90 degrees.

Figure 10:
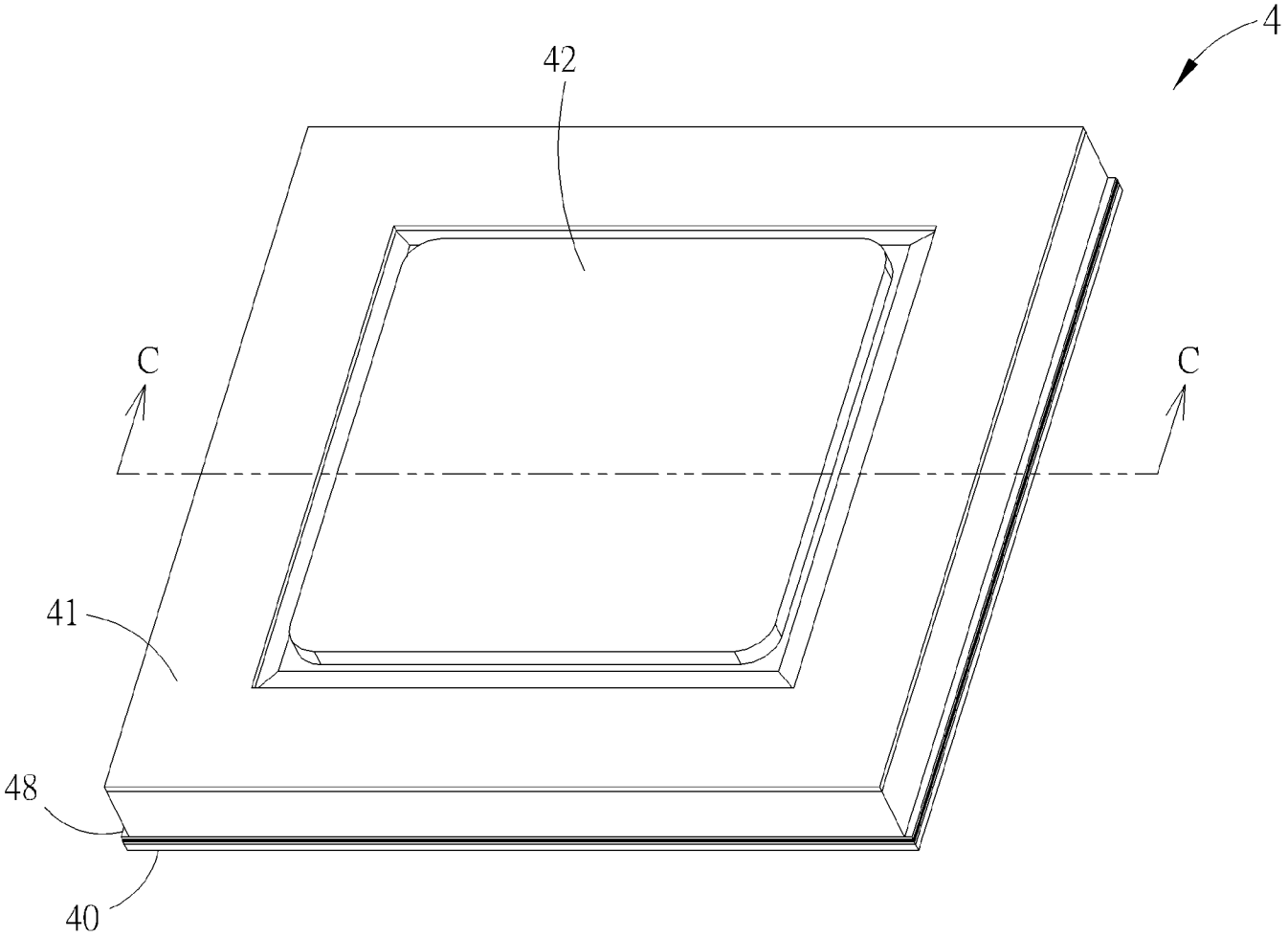
FIG. 10 is a perspective view illustrating a keyswitch according to another embodiment of the invention.
Figure 11:
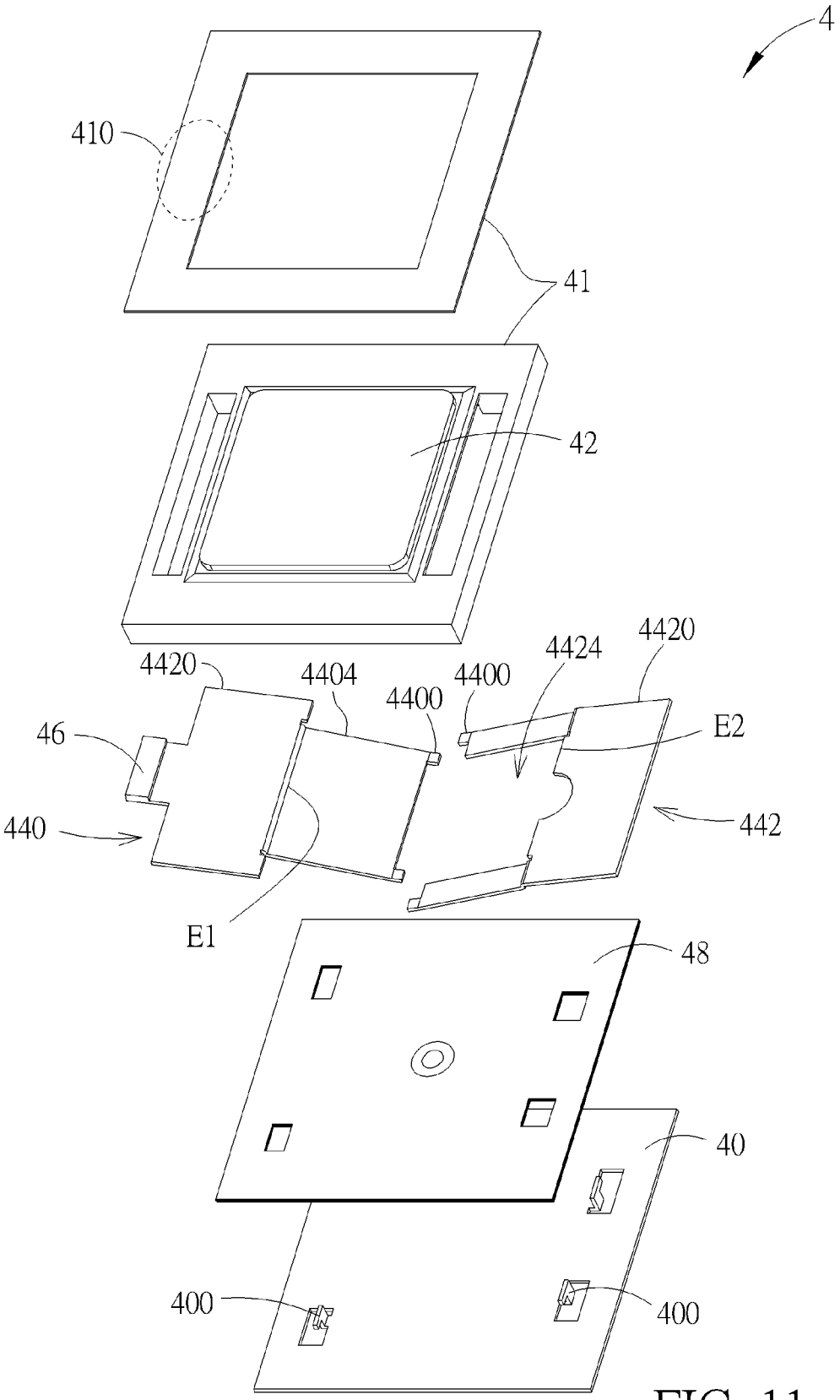
FIG. 11 is an exploded view illustrating the keyswitch shown in FIG. 10.
Figure 12:
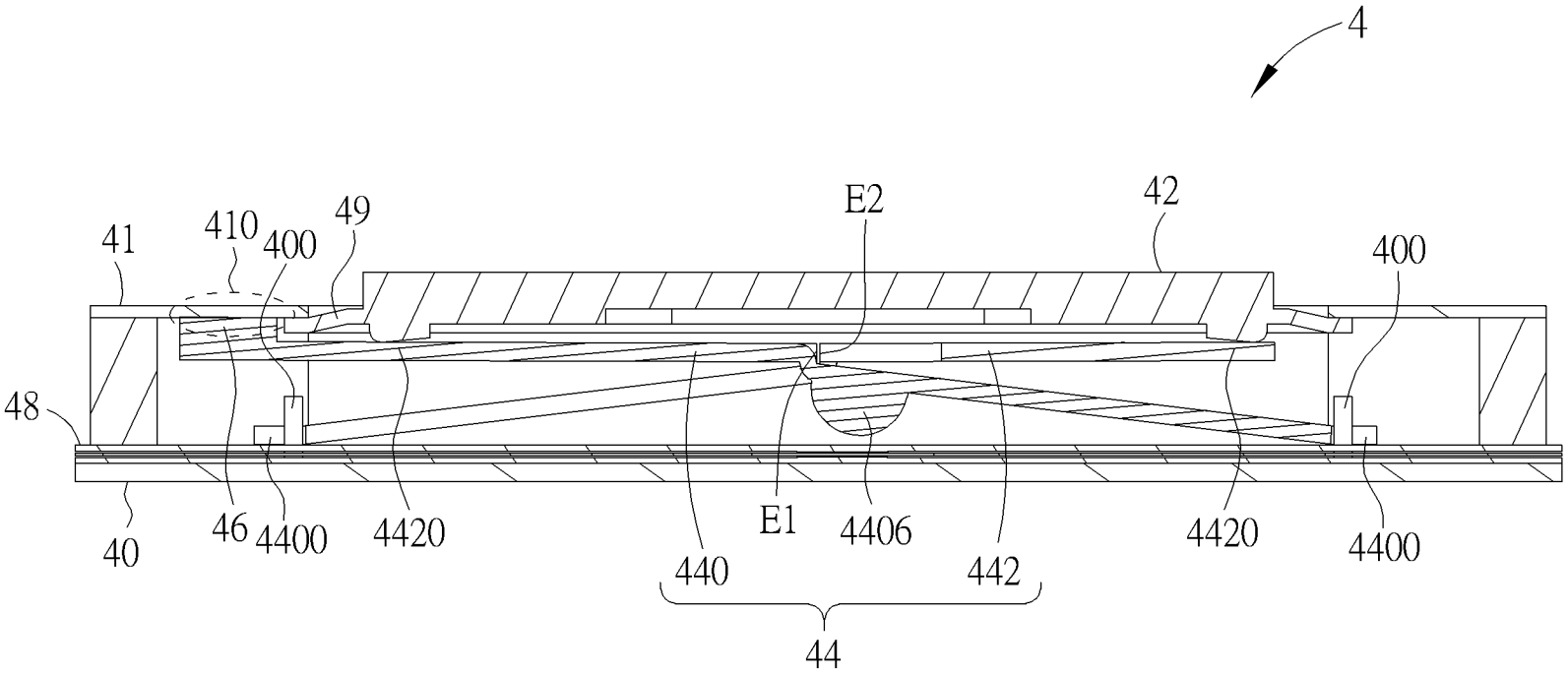
FIG. 12 is a cross-sectional view illustrating the keyswitch along line C-C shown in FIG. 12.
Figure 13:
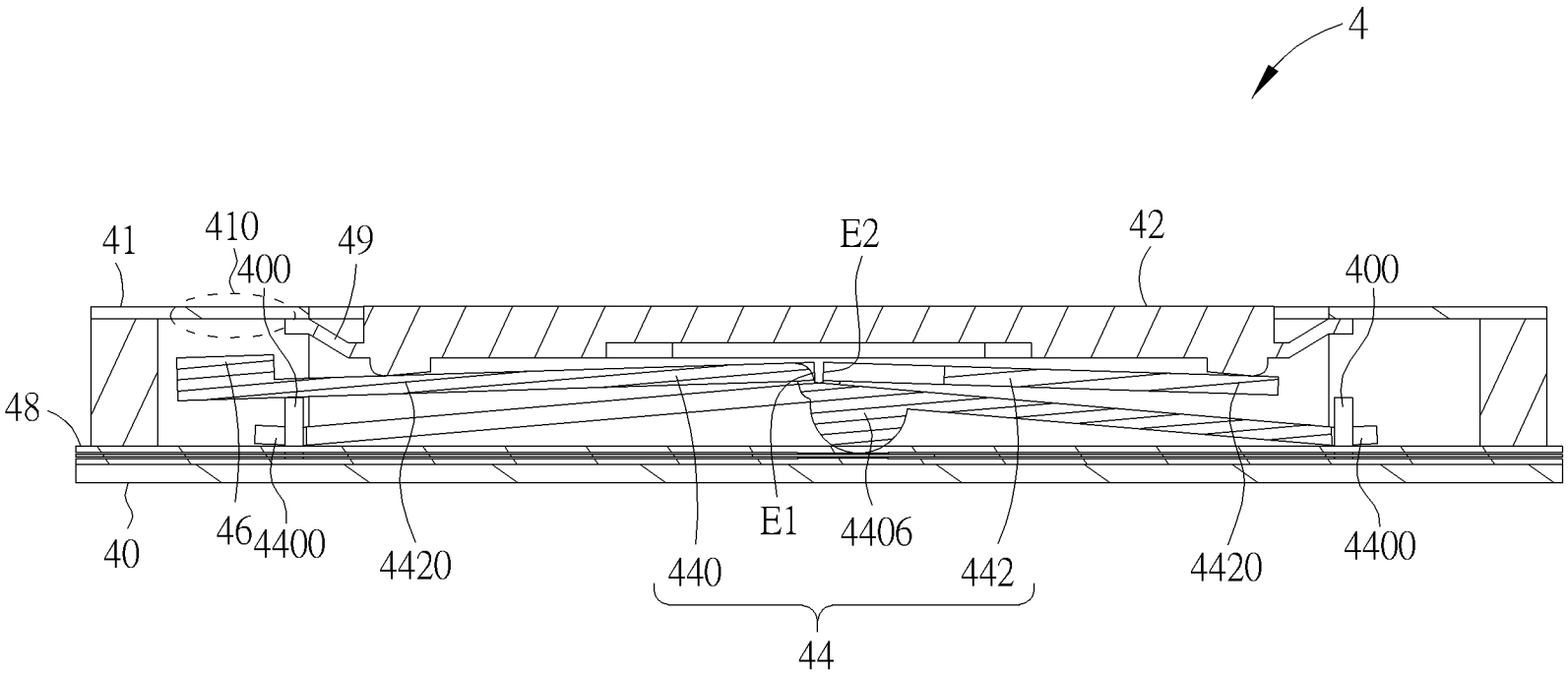
FIG. 13 is a cross-sectional view illustrating the key cap shown in FIG. 12 being pressed.

Referring to FIGS. 10 to 13, FIG. 10 is a perspective view illustrating a keyswitch 4 according to another embodiment of the invention, FIG. 11 is an exploded view illustrating the keyswitch 4 shown in FIG. 10, FIG. 12 is a cross-sectional view illustrating the keyswitch 4 along line C-C shown in FIG. 12, and FIG. 13 is a cross-sectional view illustrating the key cap 42 shown in FIG. 12 being pressed. As shown in FIGS. 10 to 13, the keyswitch 4 comprises a base 40, a frame 41, a key cap 42, a support device 44 and a circuit board 48. In this embodiment, the combination of the base 40 and the frame 41 is a casing of the keyswitch 4. In practical applications, the circuit board 48 may be, but not limited to, a membrane circuit board.

The frame 41 is disposed on the base 40 and the key cap 42 is disposed in the frame 41. In this embodiment, the key cap 42 may be connected to the frame 41 by a flexible material 49. The support device 44 is disposed between the base 40 and the key cap 42 and rotatably connected to the key cap 42 and the base 40. In this embodiment, the support device 44 may comprise a first support member 440 and a second support member 442. Each of the first support member 440 and the second support member 442 comprises a first connecting portion 4400 and a second connecting portion 4420, wherein the first connecting portion 4400 is rotatably connected to the base 40 and the second connecting portion 4420 is rotatably connected to the key cap 42. In this embodiment, the first connecting portion 4400 is rotatably connected to a connecting socket 400 of the base 40 and the second connecting portion 4420 abuts against the key cap 42 so as to be rotatably connected to the key cap 42, but the invention is not limited to this embodiment. Accordingly, the key cap 42 can move with the support device 44 between a non-pressed position (as shown in FIG. 12) and a pressed position (as shown in FIG. 13). Furthermore, the first support member 440 has a first linking portion 4404 and the second support member 442 has a second linking portion 4424. The first linking portion 4404 abuts against the second member 442 and the second linking portion 4424 abuts against the first support member 440 such that the first support member 440 and the second support member 442 can rotate simultaneously when the key cap 42 is pressed or the external force is removed. In this embodiment, the first linking portion 4404 is a plate-shaped structure and the second linking portion 4424 is a U-shaped recess, wherein the plate-shaped structure is disposed in the U-shaped recess such that a first edge E1 of the plate-shaped structure abuts against a second edge E2 of the U-shaped recess.

The frame 41 has a first magnetic area 410 and the first support member 440 of the support device 44 has a second magnetic area 46 corresponding to the first magnetic area 410. One of the first magnetic area 410 and the second magnetic area 46 may be a magnetic object (e.g. magnet) and the other one of the first magnetic area 410 and the second magnetic area 46 may be a magnetic object (e.g. magnet) or a magnetic induction material (e.g. iron or other metals). In this embodiment, the second magnetic area 46 may be a magnetic object and the first magnetic area 410 may be a magnetic induction material. In practical applications, the support device 44 may be made of magnetic induction material wholly. Furthermore, in another embodiment, the first magnetic area 410 and the second magnetic area 46 both may be magnets.

When the key cap 42 is not pressed, a magnetic attraction force between the first magnetic area 410 and the second magnetic area 46 keeps the key cap 42 at the non-pressed position (as shown in FIG. 12). When a position of the key cap 42, which is corresponding to the first support member 440, is pressed by an external force, which can overcome the magnetic attraction force, the second magnetic area 46 moves away from the first magnetic area 410, the key cap 42 moves with the support device 44 from the non-pressed position toward the pressed position (as shown in FIG. 13). When a position of the key cap 42, which is corresponding to the second support member 442, is pressed by an external force, which can overcome the magnetic attraction force, the second edge E2 presses down the first edge E1 such that the second support member 442 drives the first support member 440 to move and then the second magnetic area 46 moves away from the first magnetic area 410. Accordingly, the key cap 42 moves with the support device 44 from the non-pressed position toward the pressed position (as shown in FIG. 13). When the external force is removed, the second magnetic area 46 moves toward the first magnetic area 410 due to the magnetic attraction force such that the key cap 42 moves with the support device 44 from the pressed position toward the non-pressed position. As shown in FIG. 13, when the key cap 42 is pressed to the pressed position, a triggering portion 4406 of the first support member 440 will trigger switch of the circuit board 48 so as to execute input function correspondingly.

Figure 14:
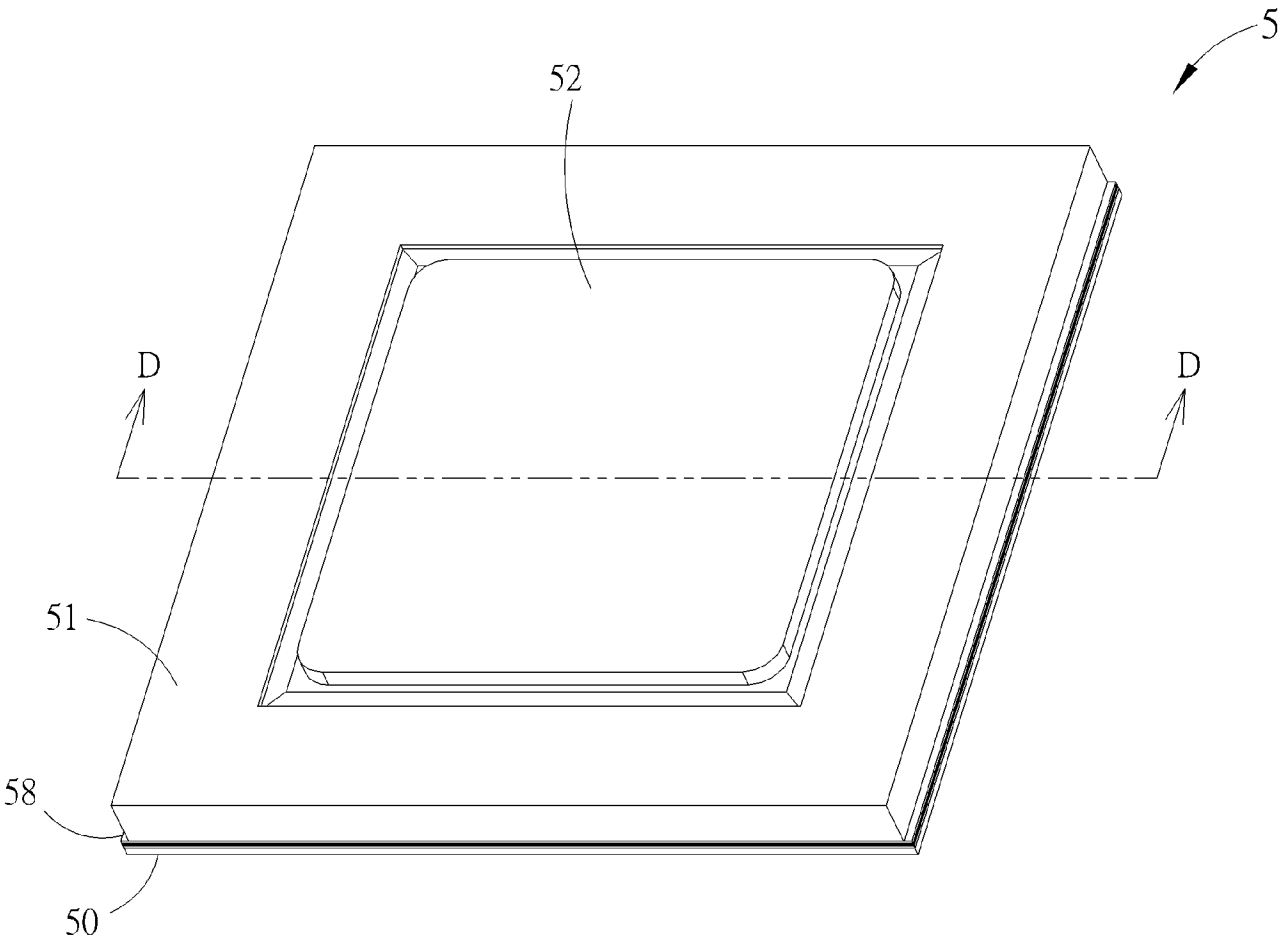
FIG. 14 is a perspective view illustrating a keyswitch according to another embodiment of the invention.
Figure 15:
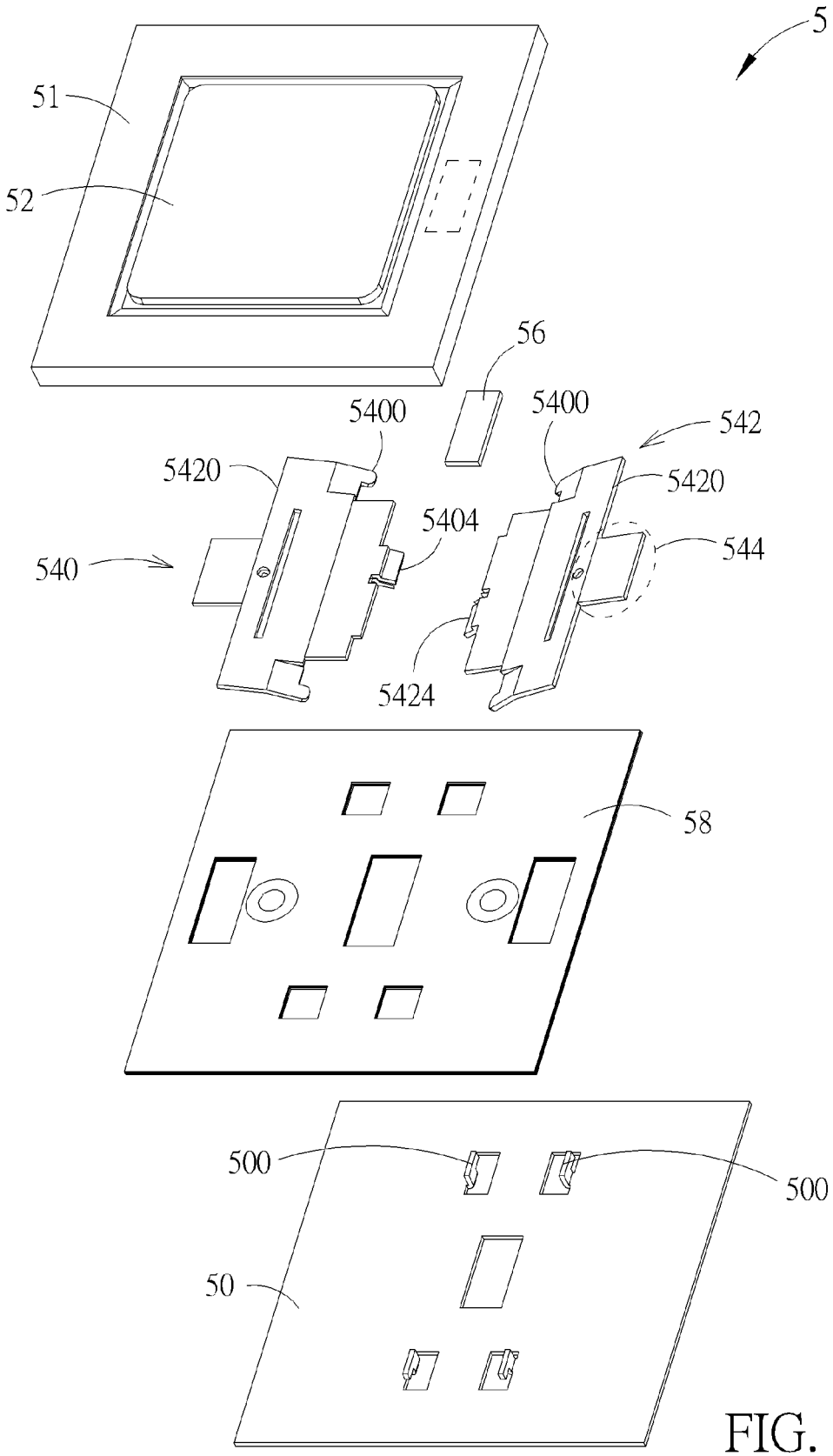
FIG. 15 is an exploded view illustrating the keyswitch shown in FIG. 14.
Figure 16:
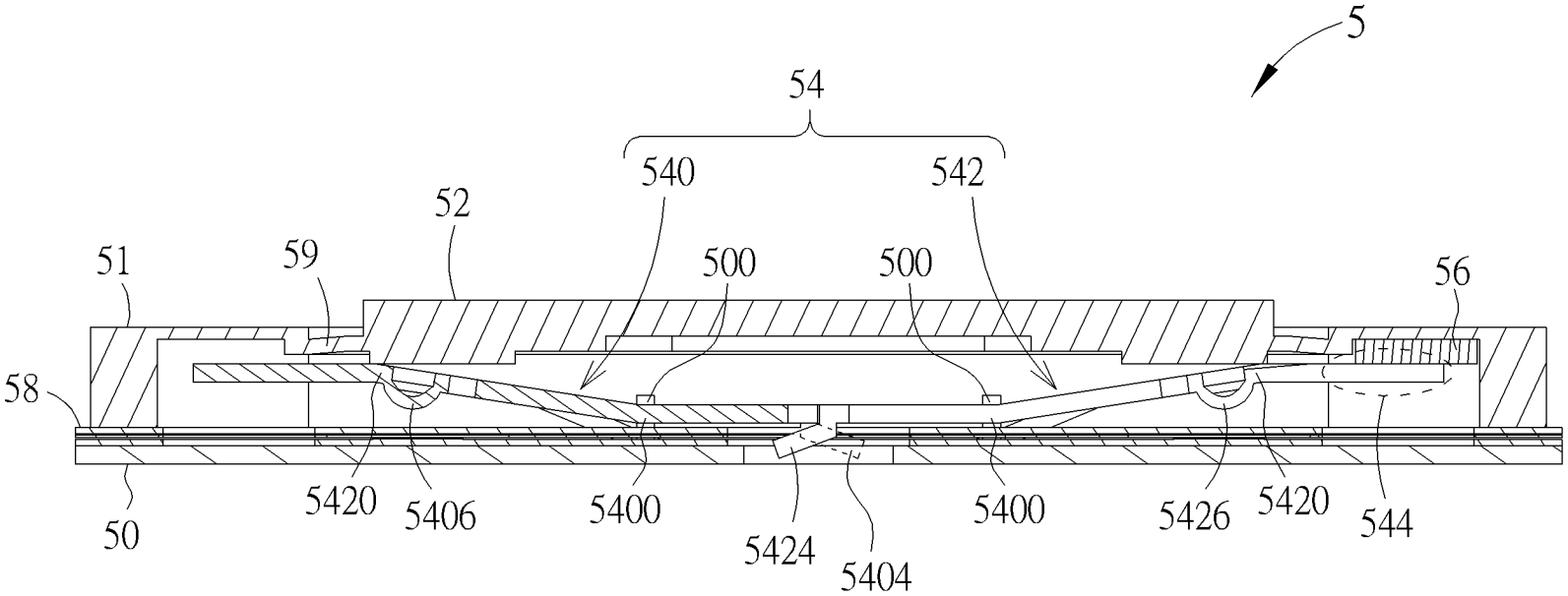
FIG. 16 is a cross-sectional view illustrating the keyswitch along line D-D shown in FIG. 14.
Figure 17:
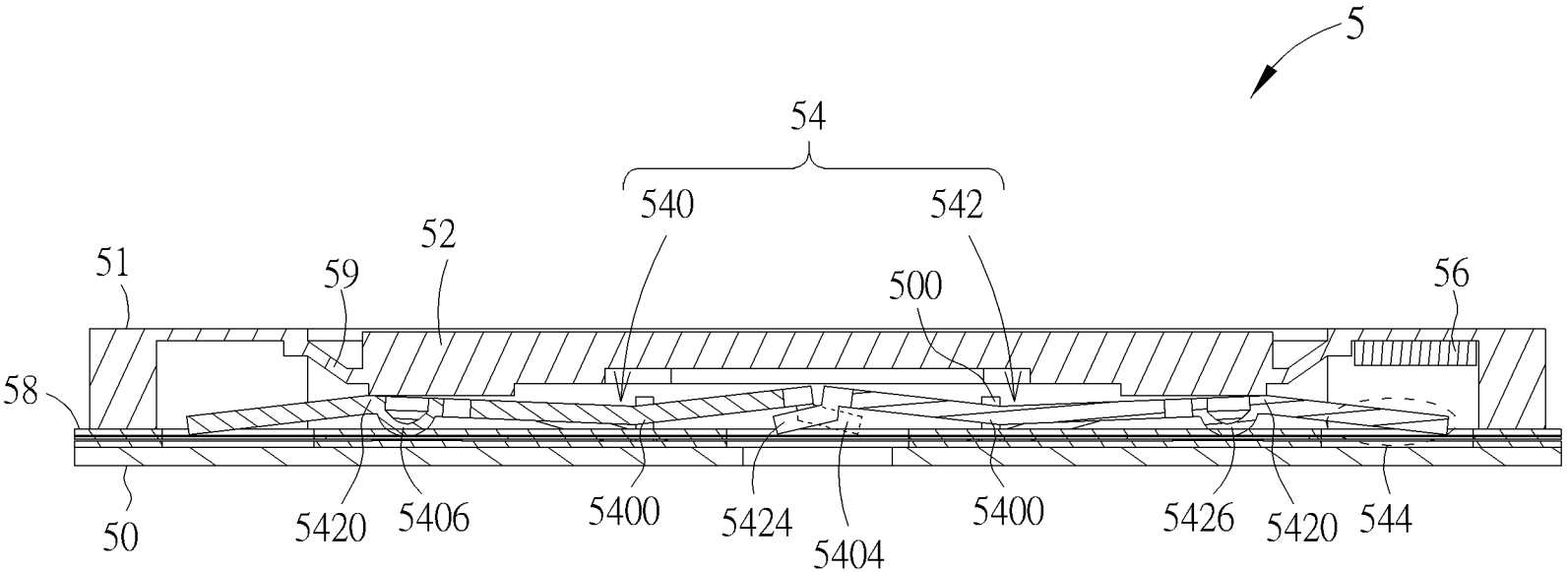
FIG. 17 is a cross-sectional view illustrating the key cap shown in FIG. 16 being pressed.

Referring to FIGS. 14 to 17, FIG. 14 is a perspective view illustrating a keyswitch 5 according to another embodiment of the invention, FIG. 15 is an exploded view illustrating the keyswitch 5 shown in FIG. 14, FIG. 16 is a cross-sectional view illustrating the keyswitch 5 along line D-D shown in FIG. 14, and FIG. 17 is a cross-sectional view illustrating the key cap 52 shown in FIG. 16 being pressed. As shown in FIGS. 14 to 17, the keyswitch 5 comprises a base 50, a frame 51, a key cap 52, a support device 54 and a circuit board 58. In this embodiment, the combination of the base 50 and the frame 51 is a casing of the keyswitch 5. In practical applications, the circuit board 58 may be, but not limited to, a membrane circuit board.

The frame 51 is disposed on the base 50 and the key cap 52 is disposed in the frame 51. In this embodiment, the key cap 52 may be connected to the frame 51 by a flexible material 59. The support device 54 is disposed between the base 50 and the key cap 52 and rotatably connected to the key cap 52 and the base 50. In this embodiment, the support device 54 may comprise a first support member 540 and a second support member 542. Each of the first support member 540 and the second support member 542 comprises a first connecting portion (i.e. a first end portion) 5400 and a second connecting portion (i.e. a central portion) 5420, wherein the first connecting portion 5400 is rotatably connected to the base 50 and the second connecting portion 5420 is rotatably connected to the key cap 52. In this embodiment, the first connecting portion 5400 is rotatably connected to a connecting socket 500 of the base 50 and the second connecting portion 5420 abuts against the key cap 52 so as to be rotatably connected to the key cap 52, but the invention is not limited to this embodiment. In other words, the first connecting portion 5400 is confined in the connecting socket 500 such that the first end portion is rotatably connected to the base 50. Accordingly, the key cap 52 can move with the support device 54 between a non-pressed position (as shown in FIG. 16) and a pressed position (as shown in FIG. 17). Furthermore, the first support member 540 has a first linking portion 5404 and the second support member 542 has a second linking portion 5424. The first linking portion 5404 abuts against the second member 542 and the second linking portion 5424 abuts against the first support member 540 such that the first support member 540 and the second support member 542 can rotate simultaneously when the key cap 52 is pressed or the external force is removed.

The frame 51 has a first magnetic area 56 and the support device 54 has a second magnetic area (i.e. a second end portion) 544 corresponding to the first magnetic area 56. One of the first magnetic area 56 and the second magnetic area 544 may be a magnetic object (e.g. magnet) and the other one of the first magnetic area 56 and the second magnetic area 544 may be a magnetic object (e.g. magnet) or a magnetic induction material (e.g. iron or other metals). In this embodiment, the first magnetic area 56 may be a magnetic object and the second magnetic area 544 may be a magnetic induction material. In practical applications, the support device 54 may be made of magnetic induction material wholly. Furthermore, in another embodiment, the first magnetic area 56 and the second magnetic area 544 both may be magnets.

When the key cap 52 is not pressed, a magnetic attraction force between the first magnetic area 56 and the second magnetic area 544 keeps the key cap 52 at the non-pressed position (as shown in FIG. 16). When the key cap 52 is pressed by an external force, which can overcome the magnetic attraction force, such that the second magnetic area 544 moves away from the first magnetic area 56, the second magnetic area 544 pivots on the first connecting portion (i.e. the first end portion) 5400 such that the key cap 52 moves with the support device 54 from the non-pressed position toward the pressed position (as shown in FIG. 17). When the external force is removed, the second magnetic area 544 moves toward the first magnetic area 56 due to the magnetic attraction force and the second magnetic area 544 drives the first support member 540 and the second support member 542 of the support device 54 to pivot on the first connecting portion (i.e. the first end portion) 5400 such that the key cap 52 moves with the support device 54 from the pressed position toward the non-pressed position. As shown in FIG. 17, when the key cap 52 is pressed to the pressed position, a triggering portion 5406 of the first support member 540 and a triggering portion 5426 of the second support member 542 will trigger switches of the circuit board 58 so as to execute input function correspondingly.

As shown in FIG. 16, the first support member 540 is formed as a V-shaped structure, wherein the first support member 540 has a first end portion 5400 and a second end portion 544 and an angle included between the first end portion 5400 and the second end portion 544 is larger than 90 degrees.

Figure 18:
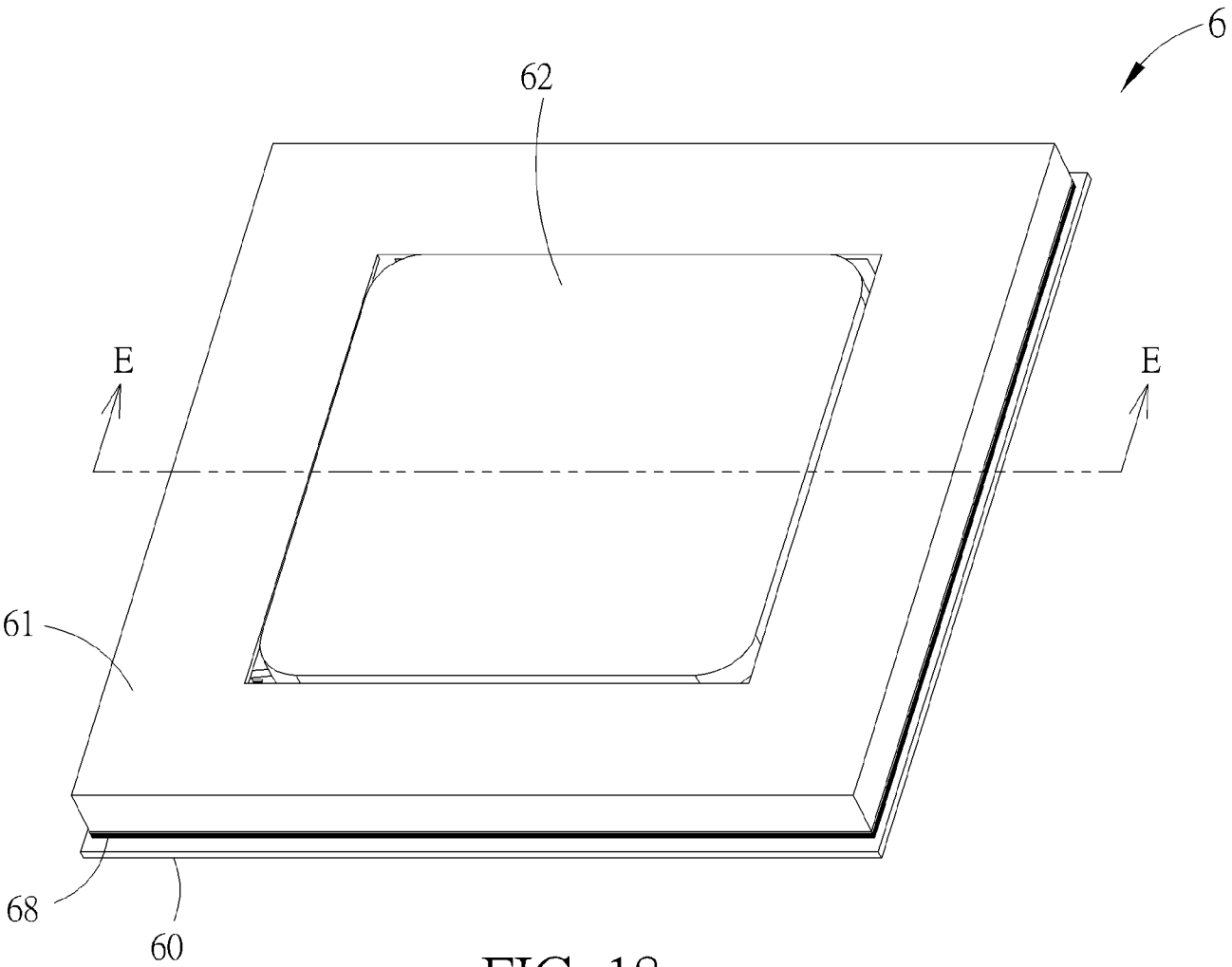
FIG. 18 is a perspective view illustrating a keyswitch according to another embodiment of the invention.
Figure 19:
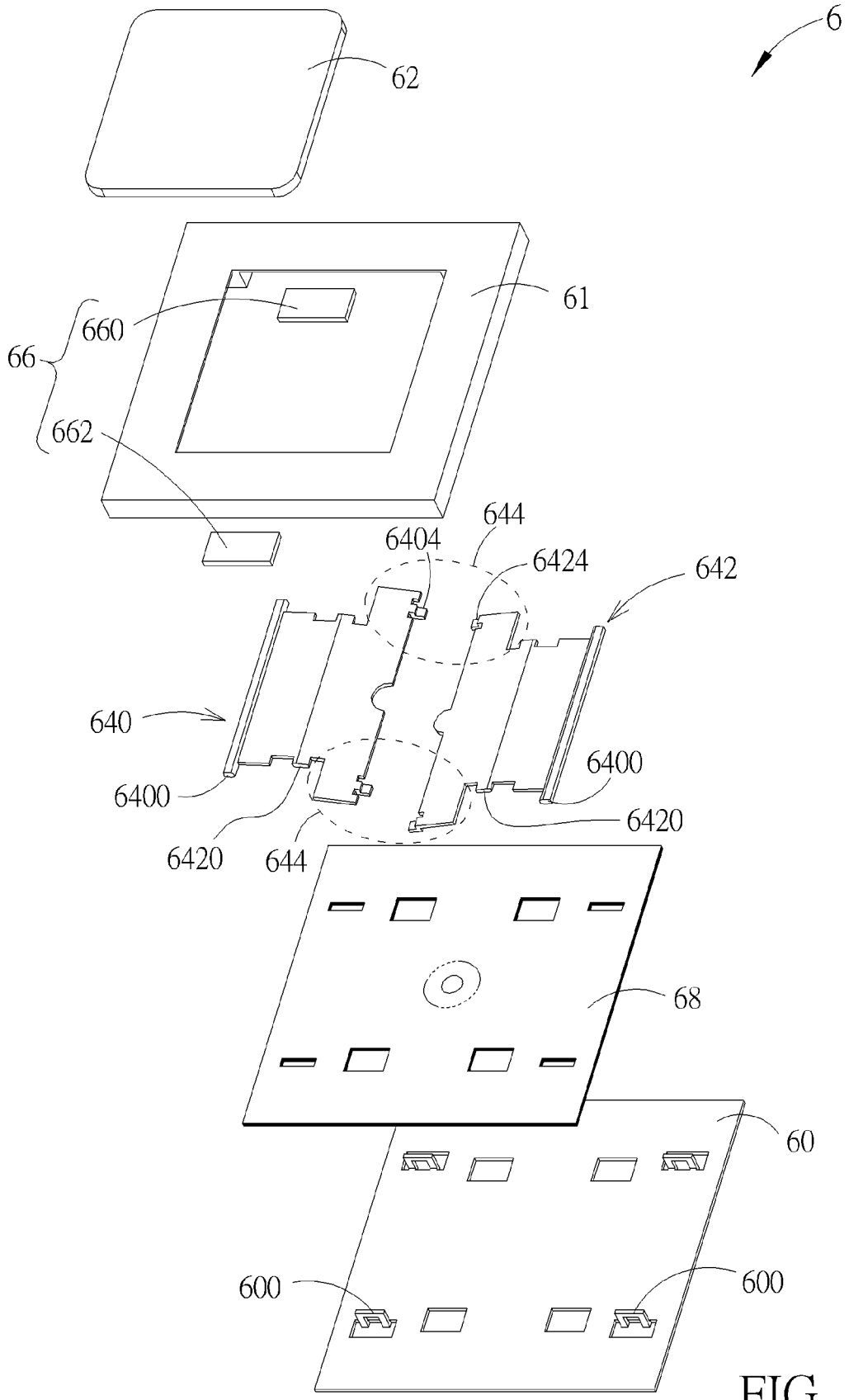
FIG. 19 is an exploded view illustrating the keyswitch shown in FIG. 18.
Figure 20:
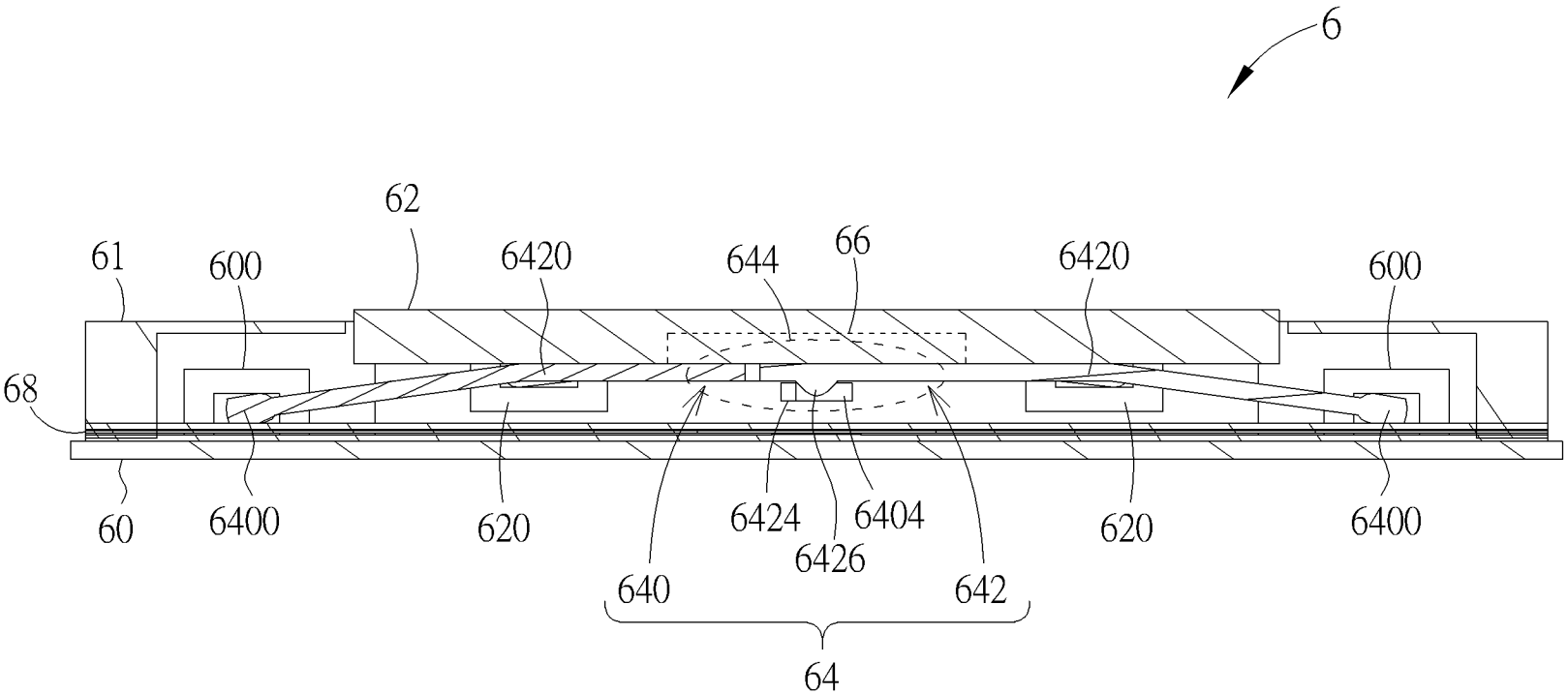
FIG. 20 is a cross-sectional view illustrating the keyswitch along line E-E shown in FIG. 18.
Figure 21:
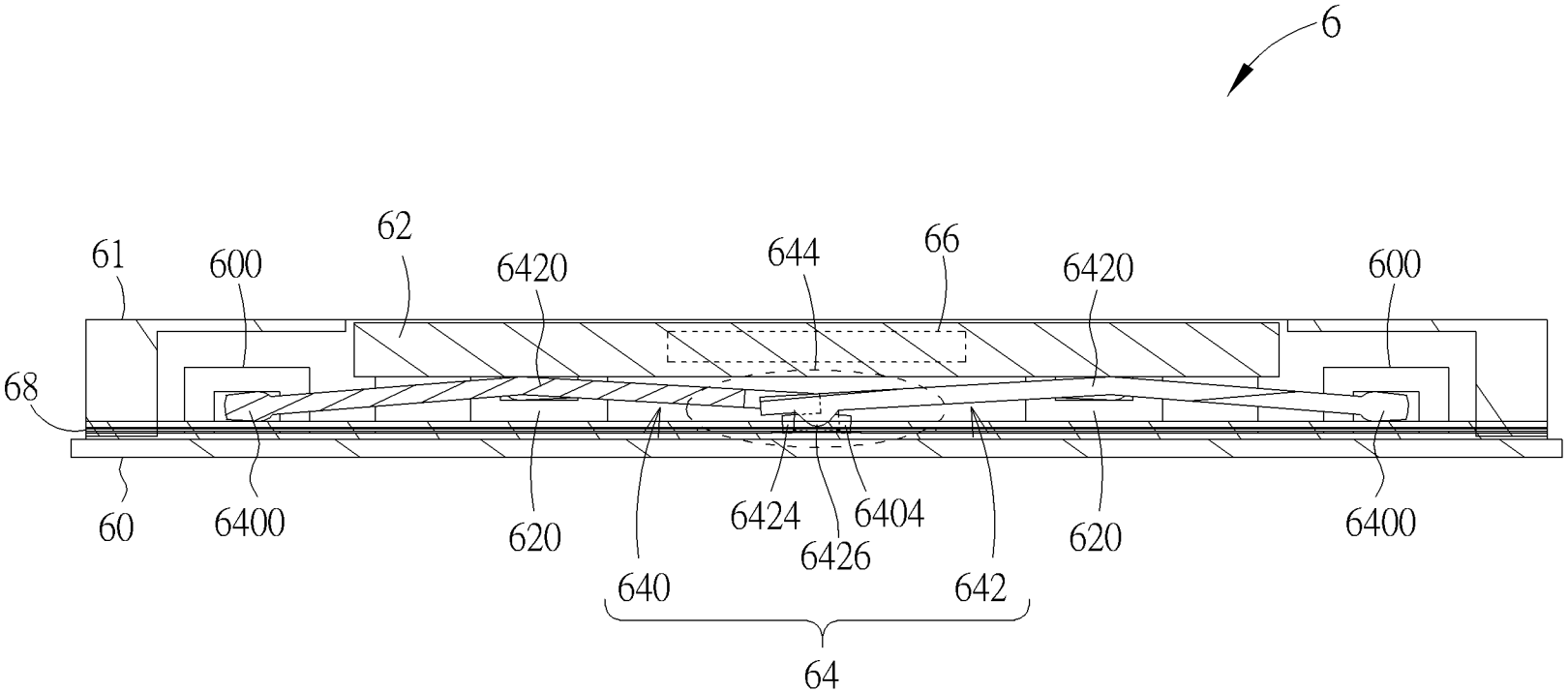
FIG. 21 is a cross-sectional view illustrating the key cap shown in FIG. 20 being pressed.

Referring to FIGS. 18 to 21, FIG. 18 is a perspective view illustrating a keyswitch 6 according to another embodiment of the invention, FIG. 19 is an exploded view illustrating the keyswitch 6 shown in FIG. 18, FIG. 20 is a cross-sectional view illustrating the keyswitch 6 along line E-E shown in FIG. 18, and FIG. 21 is a cross-sectional view illustrating the key cap 62 shown in FIG. 20 being pressed. As shown in FIGS. 18 to 21, the keyswitch 6 comprises a base 60, a frame 61, a key cap 62, a support device 64 and a circuit board 68. In this embodiment, the combination of the base 60 and the frame 61 is a casing of the keyswitch 6. In practical applications, the circuit board 68 may be, but not limited to, a membrane circuit board.

The frame 61 is disposed on the base 60 and the key cap 62 is disposed in the frame 61. The support device 64 is disposed between the base 60 and the key cap 62 and rotatably connected to the key cap 62 and the base 60. In this embodiment, the support device 64 may comprise a first support member 640 and a second support member 642. Each of the first support member 640 and the second support member 642 comprises a first connecting portion (i.e. a first end portion) 6400 and a second connecting portion (i.e. a central portion) 6420, wherein the first connecting portion 6400 is rotatably connected to the base 60 and the second connecting portion 6420 is rotatably connected to the key cap 62. In this embodiment, the first connecting portion 6400 is rotatably connected to a connecting socket 600 of the base 60 and the second connecting portion 6420 is rotatably connected to a connecting socket 620 of the key cap 62, but the invention is not limited to this embodiment. In other words, the first connecting portion 6400 is confined in the connecting socket 600 such that the first end portion is rotatably connected to the base 60. Accordingly, the key cap 62 can move with the support device 64 between a non-pressed position (as shown in FIG. 20) and a pressed position (as shown in FIG. 21). Furthermore, the first support member 640 has a first linking portion 6404 and the second support member 642 has a second linking portion 6424. The first linking portion 6404 abuts against the second member 642 and the second linking portion 6424 abuts against the first support member 640 such that the first support member 640 and the second support member 642 can rotate simultaneously when the key cap 62 is pressed or the external force is removed.

The frame 61 has a first magnetic area 66 and the first magnetic area 66 comprises a first magnetic sub-area 660 and a second magnetic sub-area 662 both disposed on opposite sides of the frame 61. The first support member 640 and the second support member 642 of the support device 64 have second magnetic areas (i.e. second end portions) 644 corresponding to the first magnetic sub-area 660 and the second magnetic sub-area 662, respectively. One of the first magnetic area 66 and the second magnetic area 644 may be a magnetic object (e.g. magnet) and the other one of the first magnetic area 66 and the second magnetic area 644 may be a magnetic object (e.g. magnet) or a magnetic induction material (e.g. iron or other metals). In this embodiment, the first magnetic area 66 may be a magnetic object and the second magnetic area 644 may be a magnetic induction material. In practical applications, the support device 64 may be made of magnetic induction material wholly. Furthermore, in another embodiment, the first magnetic area 66 and the second magnetic area 644 both may be magnets.

When the key cap 62 is not pressed, a magnetic attraction force between the first magnetic sub-area 660 and the second magnetic area 644 and a magnetic attraction force between the second magnetic sub-area 662 and the second magnetic area 644 keep the key cap 62 at the non-pressed position (as shown in FIG. 20). When the key cap 62 is pressed by an external force, which can overcome the magnetic attraction forces, such that the second magnetic area 644 moves away from the first magnetic area 66, the second magnetic area 644 pivots on the second connecting portion (i.e. the central portion) 6420 such that the key cap 62 moves with the support device 64 from the non-pressed position toward the pressed position (as shown in FIG. 21). When the external force is removed, the second magnetic area 644 moves toward the first magnetic area 66 due to the magnetic attraction forces and the second magnetic area 644 drives the first support member 640 and the second support member 642 of the support device 64 to pivot on the second connecting portion (i.e. the central portion) 6420 such that the key cap 62 moves with the support device 64 from the pressed position toward the non-pressed position. As shown in FIG. 21, when the key cap 62 is pressed to the pressed position, a triggering portion 6426 of the second support member 642 will trigger switch of the circuit board 68 so as to execute input function correspondingly.

As shown in FIG. 20, the first support member 640 is formed as a V-shaped structure, wherein the first support member 640 has a first end portion 6400 and a second end portion 644 and an angle included between the first end portion 6400 and the second end portion 644 is larger than 90 degrees.

Figure 22:
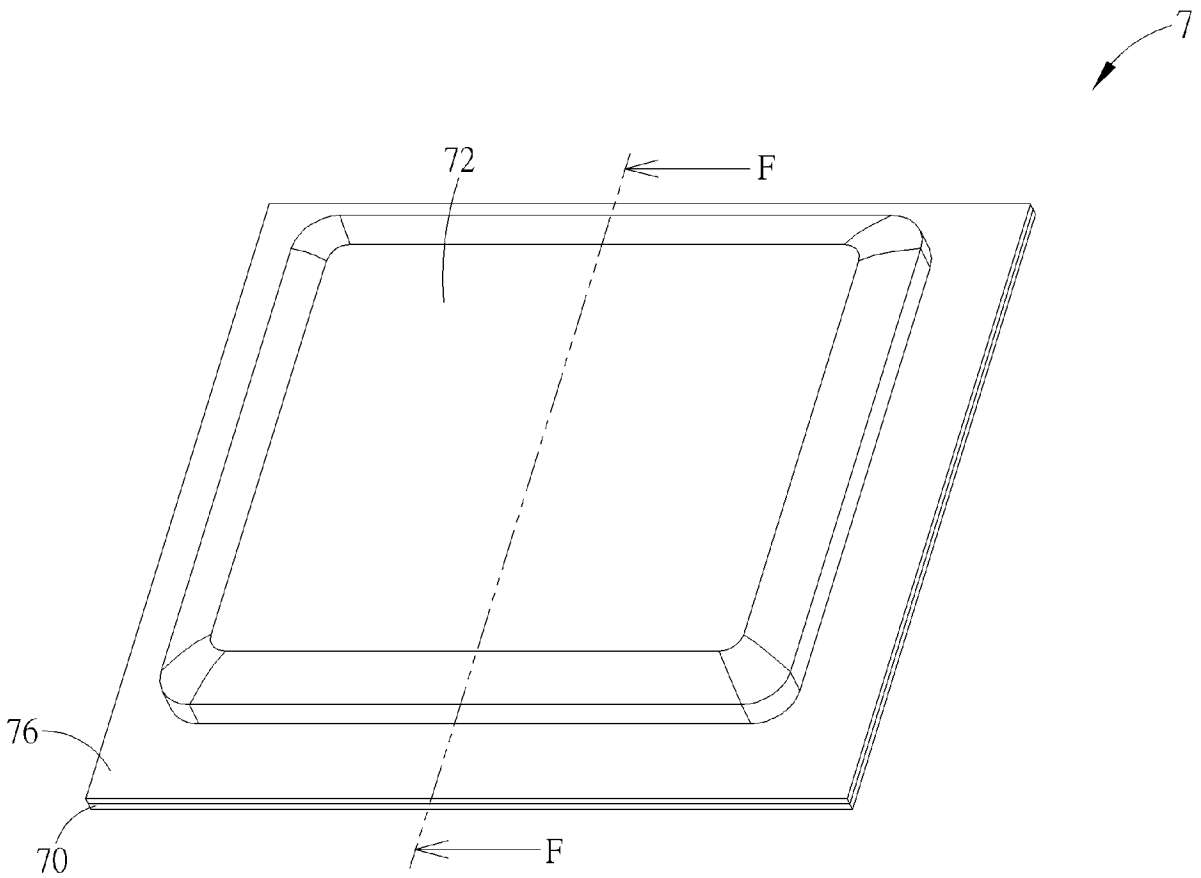
FIG. 22 is a perspective view illustrating a keyswitch according to another embodiment of the invention.
Figure 23:
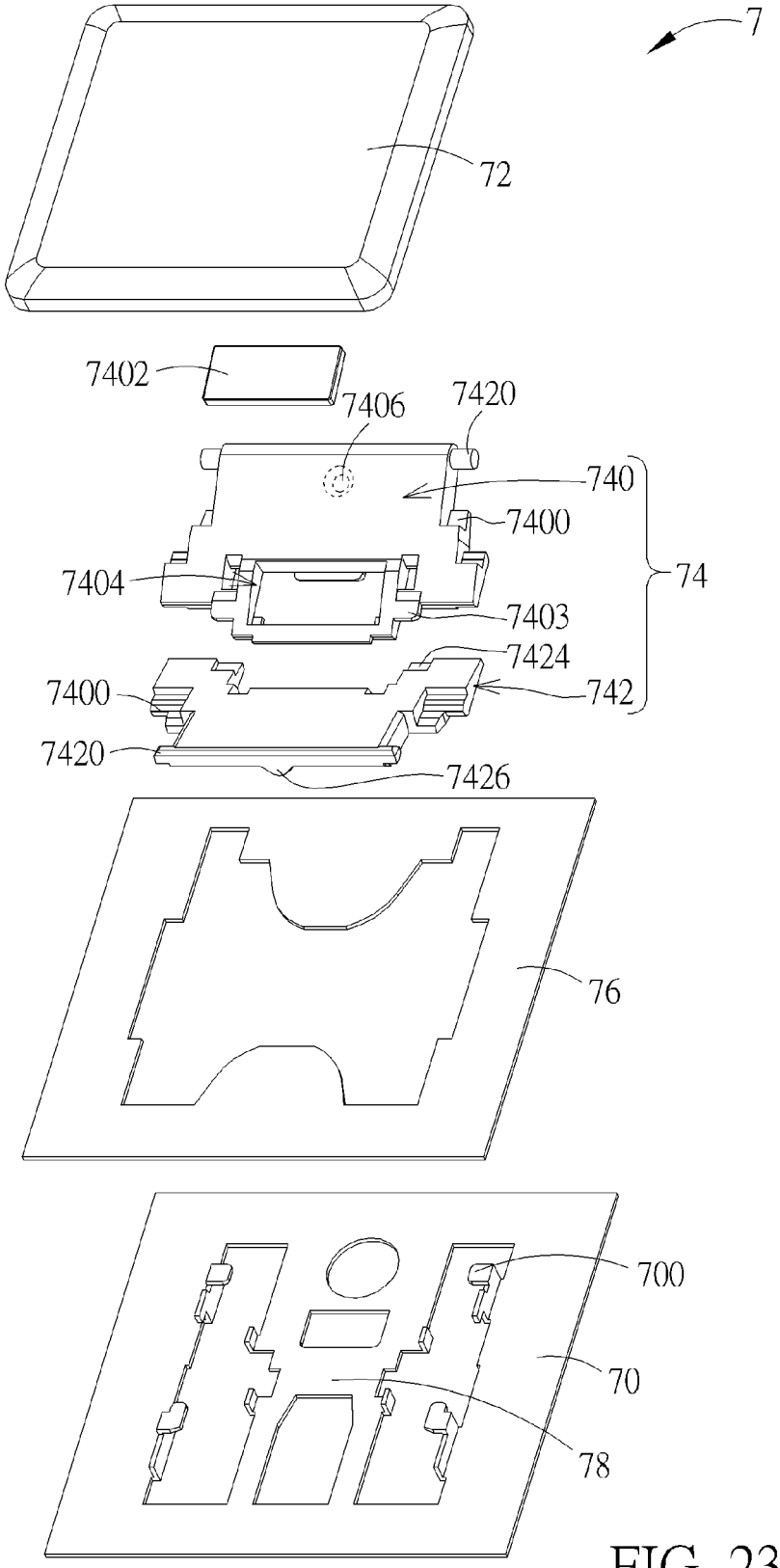
FIG. 23 is an exploded view illustrating the keyswitch shown in FIG. 22.
Figure 24:
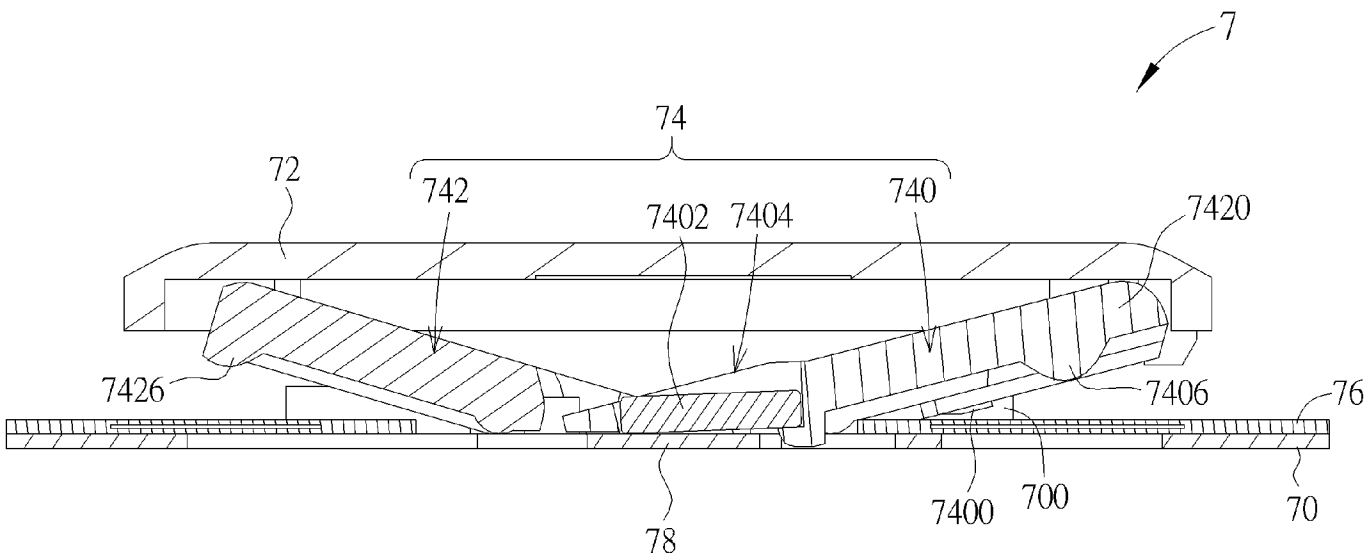
FIG. 24 is a cross-sectional view illustrating the keyswitch along line F-F shown in FIG. 22.
Figure 25:
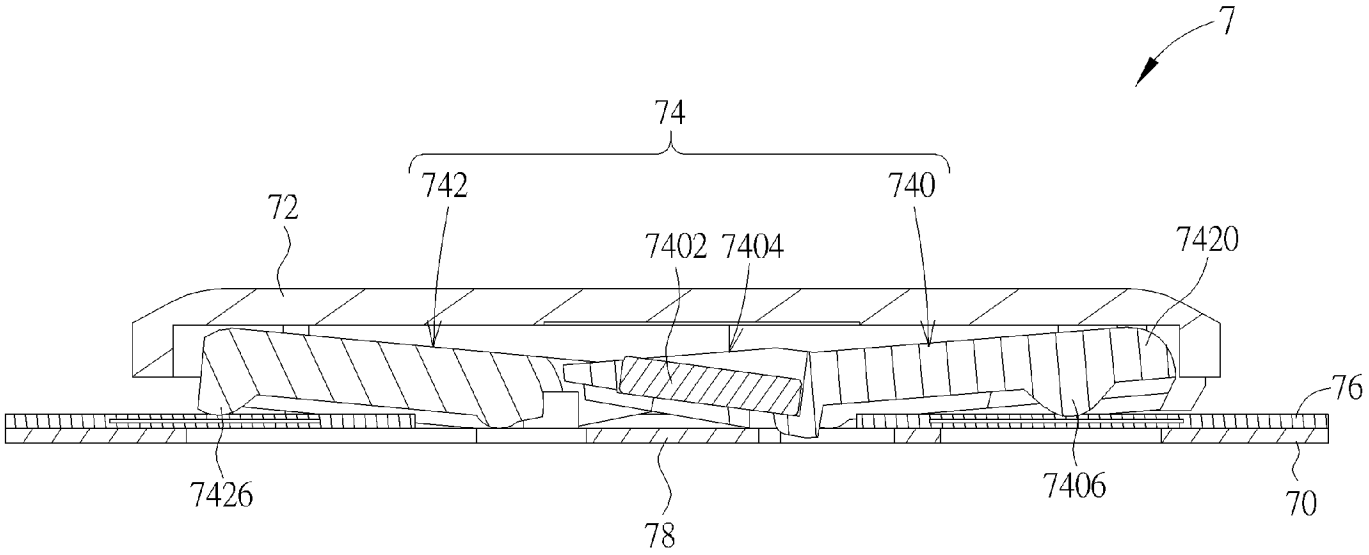
FIG. 25 is a cross-sectional view illustrating the keyswitch shown in FIG. 24 being pressed.

Referring to FIGS. 22 to 25, FIG. 22 is a perspective view illustrating a keyswitch 7 according to another embodiment of the invention, FIG. 23 is an exploded view illustrating the keyswitch 7 shown in FIG. 22, FIG. 24 is a cross-sectional view illustrating the keyswitch 7 along line F-F shown in FIG. 22, and FIG. 25 is a cross-sectional view illustrating the keyswitch 7 shown in FIG. 24 being pressed. As shown in FIGS. 22 to 25, the keyswitch 7 includes a base plate 70, a key cap 72, a support device 74 and a circuit board 76. In this embodiment, the base plate 70 is a bottom plate supporting the keyswitch 7. In practical applications, the circuit board 76 may be, but not limited to, a membrane circuit board.

The support device 74 is disposed between the base plate 70 and the key cap 72 and rotatably connected to the key cap 72 and the base plate 70. In this embodiment, the support device 74 may include a first support member 740 and a second support member 742. Each of the first support member 740 and the second support member 742 has a first connecting portion 7400 and a second connecting portion 7420, wherein the first connecting portion 7400 is rotatably connected to the base plate 70 and the second connecting portion 7420 is rotatably connected to the key cap 72. In this embodiment, the first connecting portion 7400 is rotatably connected to a connecting socket 700 of the base plate 70, but the invention is not limited to this embodiment. In other words, the first connecting portion 7400 is confined in the connecting socket 700. Accordingly, the key cap 72 can move with the support device 74 between a non-pressed position (as shown in FIG. 24) and a pressed position (as shown in FIG. 25). Furthermore, the first support member 740 further has a first linking portion 7403 and the second support member 742 further has a second linking portion 7424. The first linking portion 7403 abuts against the second linking portion 7424 such that the first support member 740 and the second support member 742 can rotate simultaneously when the key cap 72 is pressed or an external force is removed.

In this embodiment, as shown in FIG. 23, the base plate 70 has a first magnetic area 78 and the first support member 740 further has a receiving opening 7404 and a second magnetic area 7402 corresponding to the first magnetic area 78. The second magnetic area 7402 is disposed within the receiving opening 7404. One of the first magnetic area 78 and the second magnetic area 7402 may be a magnetic object (e.g. magnet) and the other one of the first magnetic area 78 and the second magnetic area 7402 may be a magnetic object (e.g. magnet) or a magnetic induction material (e.g. iron or other metals). In this embodiment, the base plate 70 is made of iron material, so the base plate 70 itself (including the first magnetic area 78) inherently is made of magnetic induction material, and the second magnetic area 7402 is a magnet. In practical applications, the support device 74 may be made of magnetic induction material wholly. Furthermore, in another embodiment, the first magnetic area 78 and the second magnetic area 7402 both may be magnets.

When the key cap 72 is not pressed, a magnetic attraction force between the first magnetic area 78 and the second magnetic area 7402 keeps the key cap 72 at the non-pressed position (as shown in FIG. 24). When the key cap 72 is pressed by an external force, which can overcome the magnetic attraction force, such that the second magnetic area 7402 moves away from the first magnetic area 78, the second magnetic area 7402 pivots on the first connecting portion 7400 such that the key cap 72 moves with the support device 74 from the non-pressed position (as shown in FIG. 24)

toward the pressed position (as shown in FIG. 25). When the external force is removed, the second magnetic area 7402 moves toward the first magnetic area 78 due to the magnetic attraction force and the second magnetic area 7402 drives the first support member 740 and the second support member 742 of the support device 74 to pivot such that the key cap 72 moves with the support device 74 from the pressed position (as shown in FIG. 25) toward the non-pressed position (as shown in FIG. 24). As shown in FIG. 25, when the key cap 72 is pressed to the pressed position, a triggering portion 7406 of the first support member 740 and a triggering portion 7426 of the second support member 742 will trigger switches of the circuit board 76 so as to execute input function correspondingly.

Figure 26:
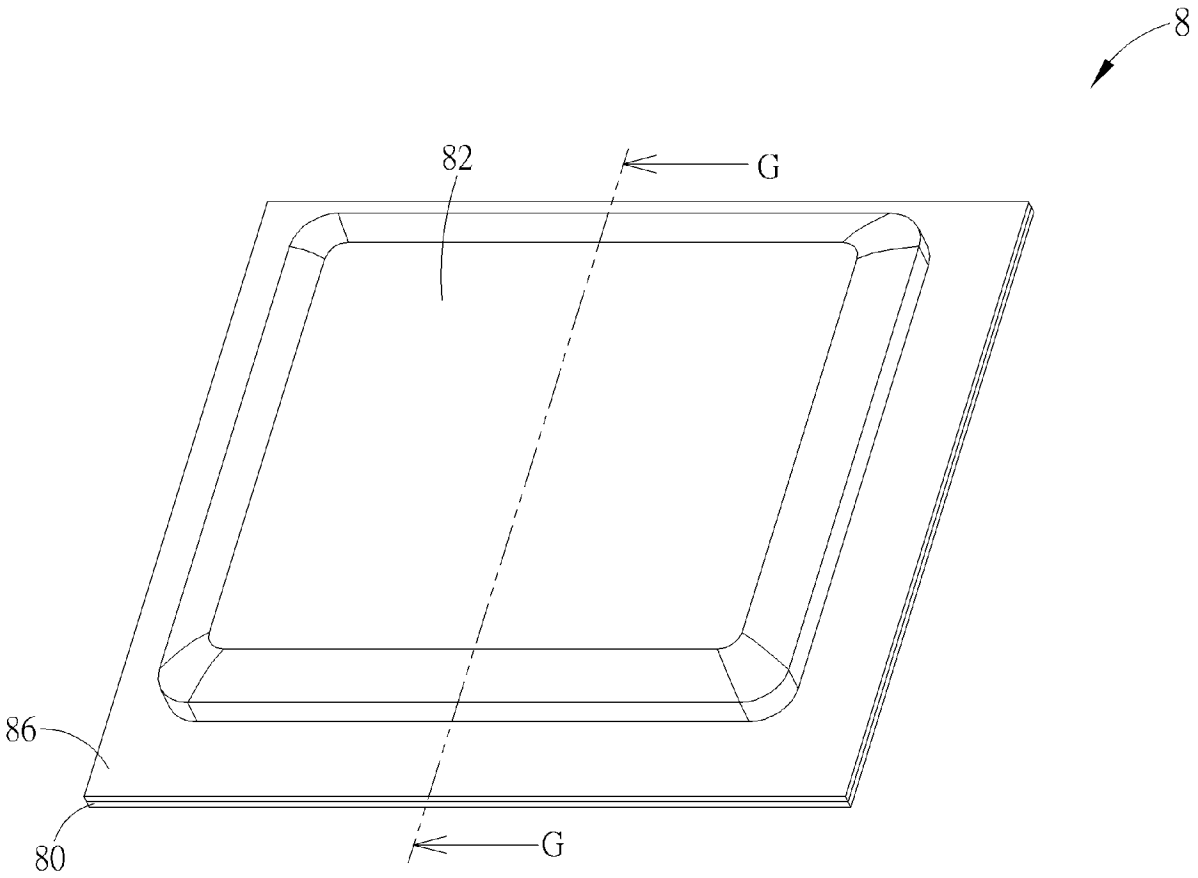
FIG. 26 is a perspective view illustrating a keyswitch according to another embodiment of the invention.
Figure 27:
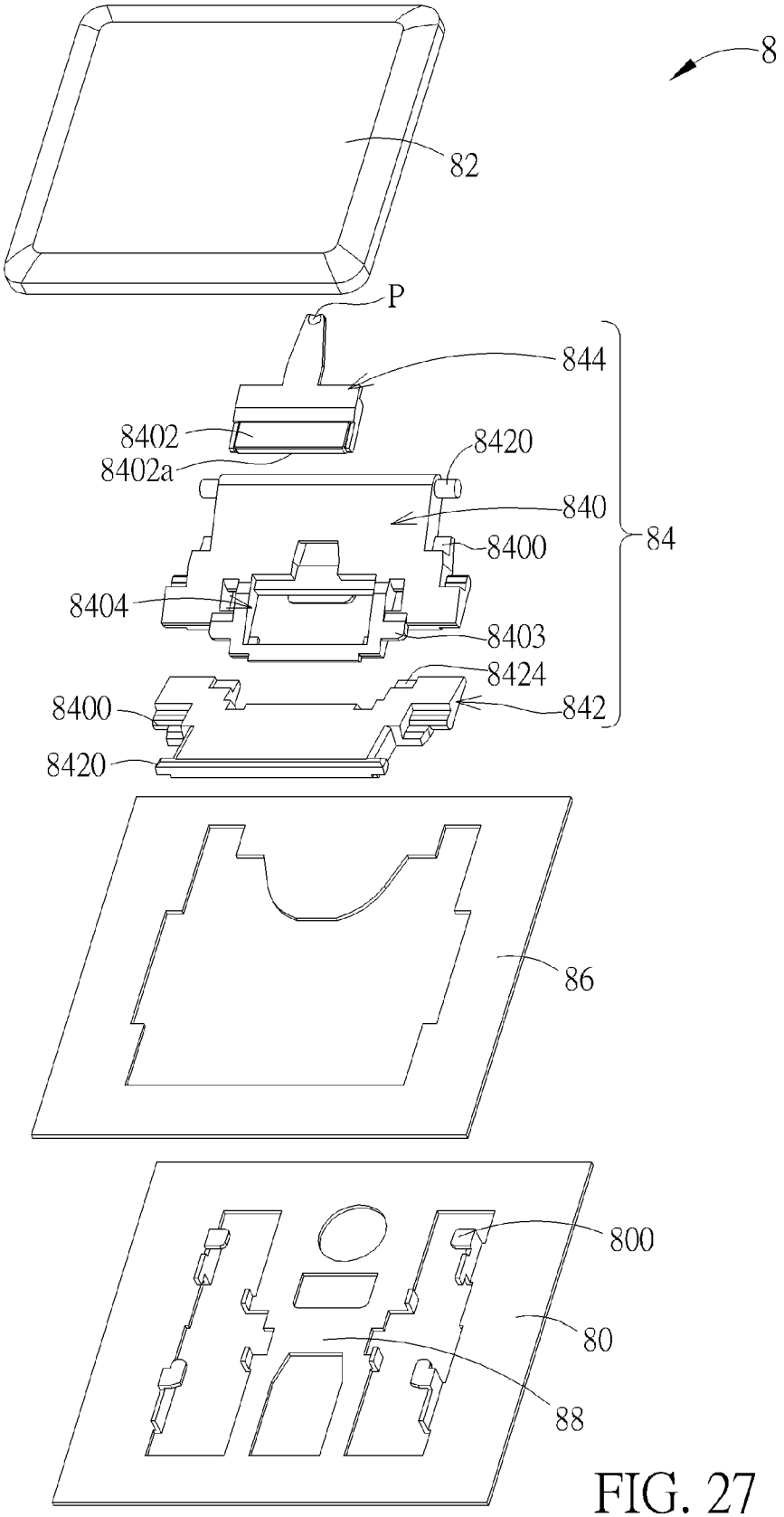
FIG. 27 is an exploded view illustrating the keyswitch shown in FIG. 26.
Figure 28:
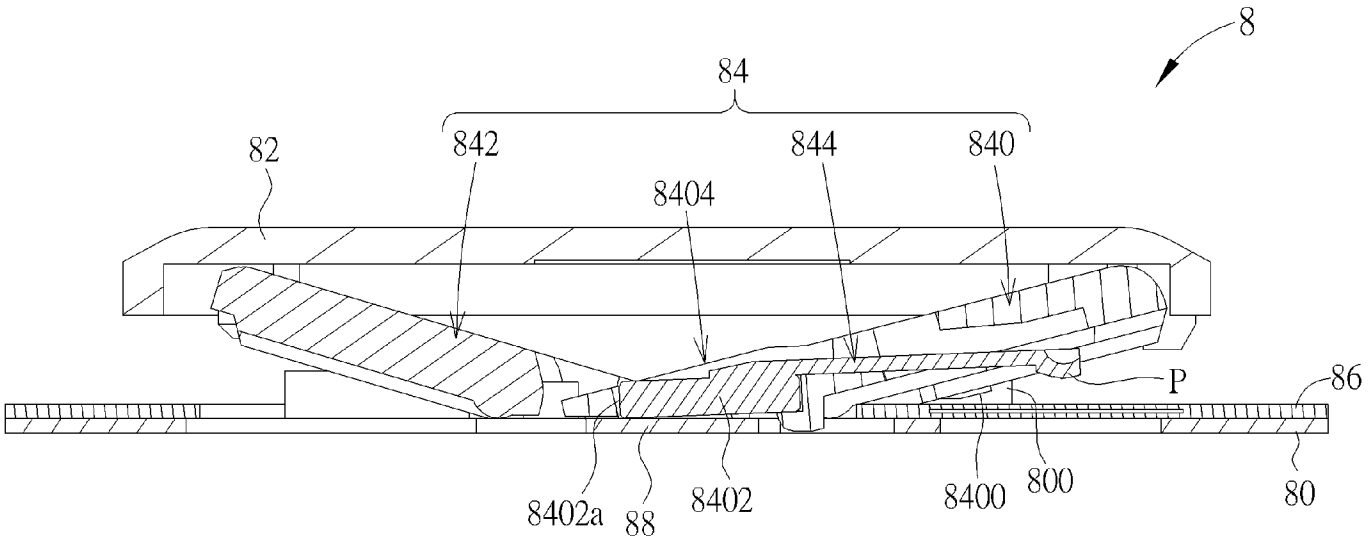
FIG. 28 is a cross-sectional view illustrating the keyswitch along line G-G shown in FIG. 26.
Figure 29:
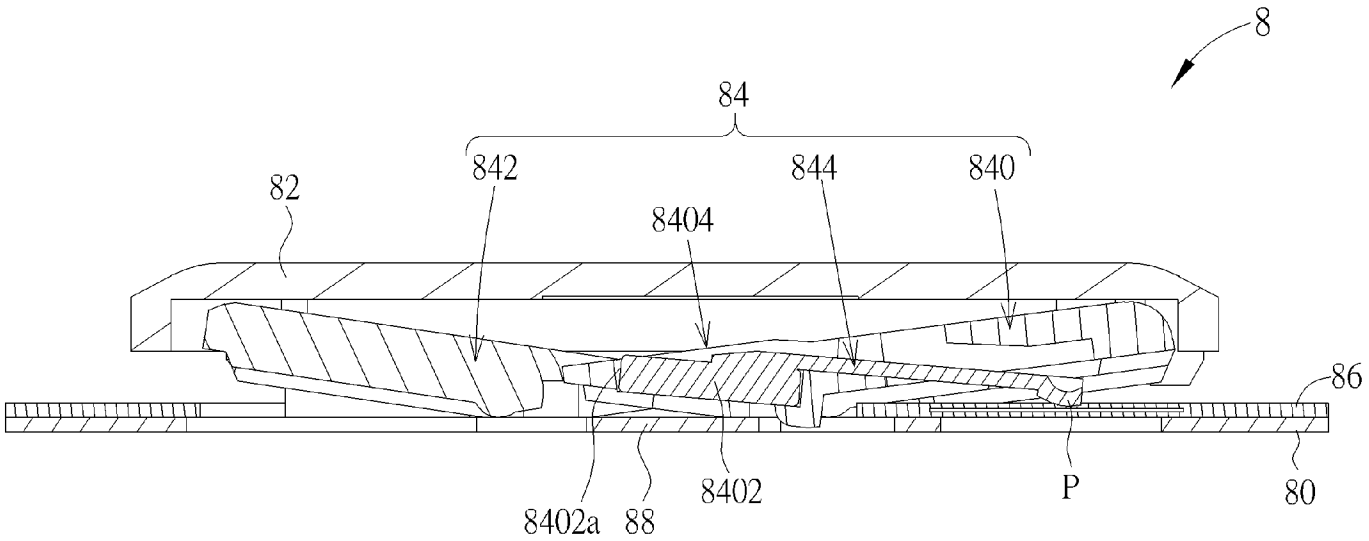
FIG. 29 is a cross-sectional view illustrating the keyswitch shown in FIG. 28 being pressed.
Figure 30:
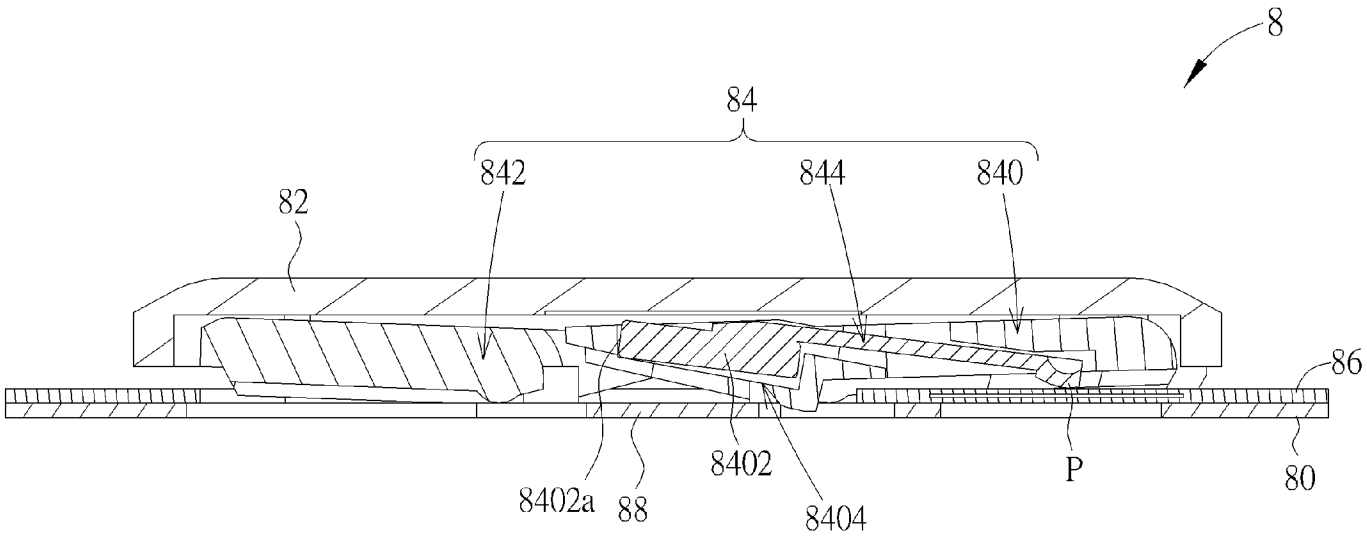
FIG. 30 is a cross-sectional view illustrating a linking arm with a second magnetic area pivoting in a receiving opening shown in FIG. 29.

Referring to FIGS. 26 to 30, FIG. 26 is a perspective view illustrating a keyswitch 8 according to another embodiment of the invention, FIG. 27 is an exploded view illustrating the keyswitch 8 shown in FIG. 26, FIG. 28 is a cross-sectional view illustrating the keyswitch 8 along line G-G shown in FIG. 26, FIG. 29 is a cross-sectional view illustrating the keyswitch 8 shown in FIG. 28 being pressed, and FIG. 30 is a cross-sectional view illustrating a linking arm 844 with a second magnetic area 8402 pivoting in a receiving opening 8404 in FIG. 29. As shown in FIGS. 26 to 30, the keyswitch 8 includes a base plate 80, a key cap 82, a support device 84 and a circuit board 86. In this embodiment, the base plate 80 is a bottom plate supporting the keyswitch 8. In practical applications, the circuit board 86 may be, but not limited to, a membrane circuit board.

Figure 31:
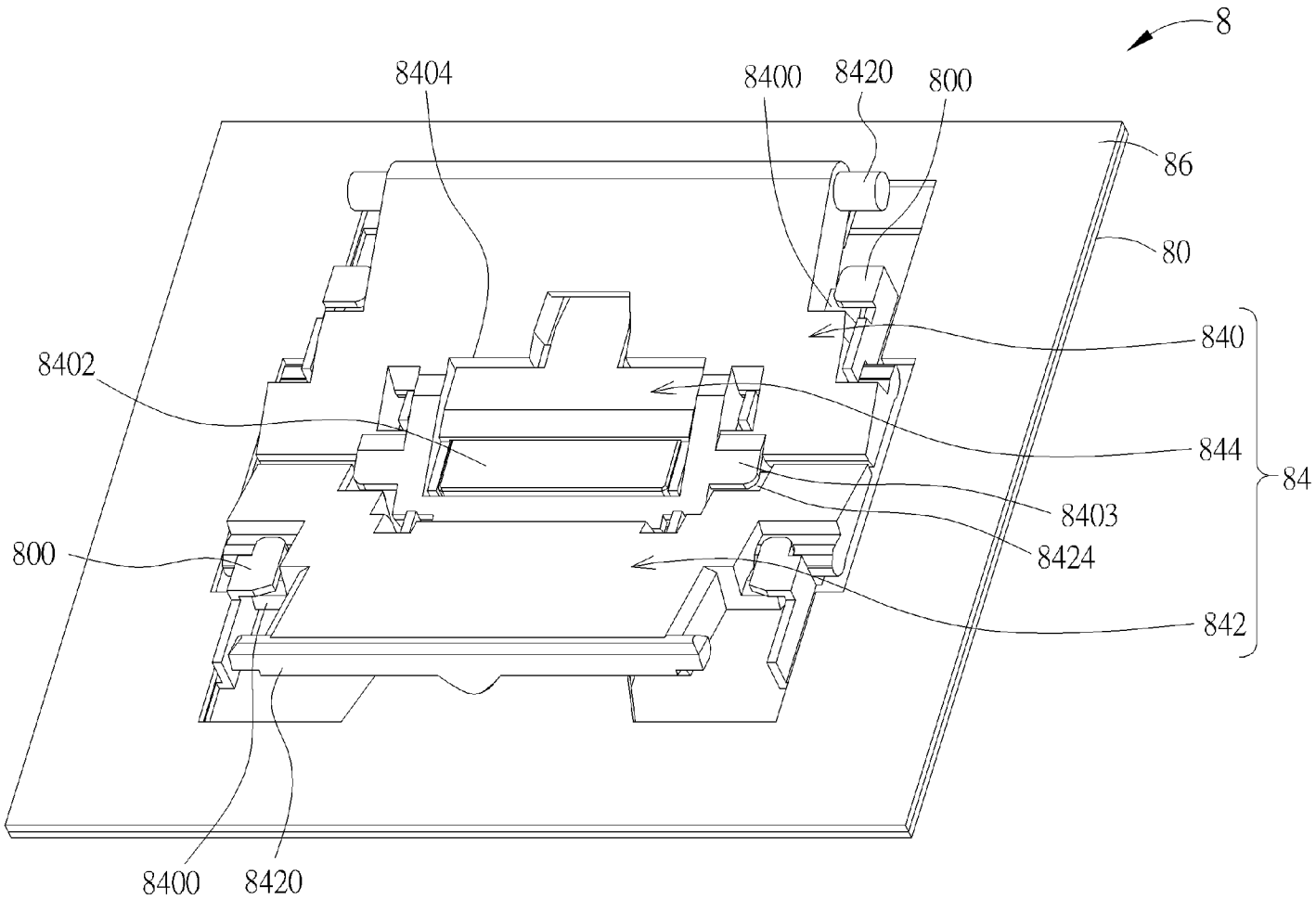
FIG. 31 is a perspective view illustrating the keyswitch shown in FIG. 26 without a key cap.

The support device 84 is disposed between the base plate 80 and the key cap 82 and rotatably connected to the key cap 82 and the base plate 80. In this embodiment, the support device 84 may include a first support member 840 and a second support member 842. Each of the first support member 840 and the second support member 842 has a first connecting portion 8400 and a second connecting portion 8420, wherein the first connecting portion 8400 is rotatably connected to the base plate 80 and the second connecting portion 8420 is rotatably connected to the keycap 82. In this embodiment, the first connecting portion 8400 is rotatably connected to a connecting socket 800 of the base plate 80, but the invention is not limited to this embodiment. In other words, the first connecting portion 8400 is confined in the connecting socket 800. Accordingly, the key cap 82 can move with the support device 84 between a non-pressed position (as shown in FIG. 28) and a pressed position (as shown in FIG. 30). Furthermore, the first support member 840 further has a first linking portion 8403 and the second support member 842 further has a second linking portion 8424. The first linking portion 8403 abuts against the second linking portion 8424 such that the first support member 840 and the second support member 842 can rotate simultaneously (as shown in FIG. 31) when the key cap 82 is pressed or an external force is removed.

In this embodiment, as shown in FIG. 27, the base plate 80 has a first magnetic area 88 and the first support member 840 further has a second magnetic area 8402 corresponding to the first magnetic area 88. The second magnetic area 8402 is disposed within the receiving opening 8404. One of the first magnetic area 88 and the second magnetic area 8402 may be a magnetic object (e.g. magnet) and the other one of the first magnetic area 88 and the second magnetic area 8402 may be a magnetic object (e.g. magnet) or a magnetic induction material (e.g. iron or other metals). In this embodiment, the base plate 80 is made of iron material, so the base plate 80 itself (including the first magnetic area 88) inherently is made of a magnetic induction material, and the second magnetic area 8402 is a magnet. In practical applications, the support device 84 may be made of magnetic induction material wholly. Furthermore, in another embodiment, the first magnetic area 88 and the second magnetic area 8402 both may be magnets.

Furthermore, the support device 84 further includes a linking arm 844, and the second magnetic area 8402 includes a fixing end 8402*a* (as shown in FIGS. 28 & 30, the left end of the second magnetic area 8402). The second magnetic area 8402 is disposed within the receiving opening 8404, and firmly fixed to the first support member 840 at the fixing end 8402*a*. The linking arm 844 is extended from the right side of the second magnetic area 8402 opposite to the left side and movably disposed in the receiving opening 8404. A downward triggering end P of the linking arm 844 extends out from the receiving opening 8404 for triggering the circuit board 86.

When the key cap 82 is not pressed, a magnetic attraction force between the first magnetic area 88 and the second magnetic area 8402 keeps the key cap 82 at the non-pressed position (as shown in FIG. 28). When the key cap 82 is pressed by an external force, which can overcome the magnetic attraction force, such that the second magnetic area 8402 moves away from the first magnetic area 88 with rotation of the first support member 840. When the first support member 840 is pivoting on the first connecting portion 8400, the second magnetic area 8402 and the linking arm 844 accordingly move and the downward triggering end P of the linking arm 844 touches the circuit board 86 (as shown in FIG. 29).

Subsequently, when the key cap 82 is further pressed deeper by the external force, the second magnetic area 8402 starts pivoting on the fixing end 8402*a*, and may also have certain deformation, so it allows the linking arm 844 move upward within the receiving opening 8404 (as shown in FIG. 30). There are two benefits: (1) at this time, the magnetic attraction force between the first magnetic area 88 and the second magnetic area 8402 assists to keep the downward triggering end P firmly abutting against the circuit board 86 without bouncing, so the electrical signal generated by the circuit board 86 will be more stable; (2) the pivoting and possible deformation of the second magnetic area 8402 can substantially reduce the deformation stress occurred to the first support member 840 when the key cap 82 is pressed by the external force. It reduces deformation of the first support member 840 during the keycap 82 is pressed so as to extend the lifetime of the keyswitch 8.

When the external force is removed, the second magnetic area 8402 moves toward the first magnetic area 88 due to the magnetic attraction force and the second magnetic area 8402 drives the first support member 840 and the second support member 842 of the support device 84 to pivot on the first connecting portions 8400 respectively such that the key cap 82 moves with the support device 84 from the pressed position (as shown in FIG. 30) toward the non-pressed position (as shown in FIG. 28).

In such a manner, since the keyswitch 8 allows the second magnetic area 8402 pivoting on the fixing end 8402*a* (as shown in FIGS. 28 & 30, the left end of the second magnetic area 8402), so that the linking arm 844 (as shown in FIGS. 28 & 30, extended from the right end of the second magnetic area 8402) can move within the receiving opening 8404 such that the magnetic attraction force between the first magnetic area 88 and the second magnetic area 8402 will assist to make the downward triggering end P firmly abut against the circuit board 86 without bouncing, so the electrical signal generated by the circuit board 86 will be more stable.

As mentioned in the above, the first magnetic area of the invention is selectively disposed on one of the casing, which may be the base plate or a combination of the base plate and the frame, and the key cap, and the support device has the second magnetic area corresponding to the first magnetic area. When the key cap is not pressed, the magnetic attraction force between the first magnetic area and the second magnetic area keeps the key cap at the non-pressed position. When the key cap is pressed by the external force such that the second magnetic area moves away from the first magnetic area, the key cap moves with the support device from the non-pressed position toward the pressed position. When the external force is removed, the second magnetic area moves toward the first magnetic area due to the magnetic attraction force such that the key cap moves with the support device from the pressed position toward the non-pressed position. Since the resilient member of the conventional keyswitch is unnecessary for the invention, the lifetime of the keyswitch of the invention can be extended effectively.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A keyswitch comprising:

a base plate having a first magnetic area;

a key cap; and a support device disposed between the base plate and the key cap, the support device comprising a first support member and a second support member, the first support member and the second support member being rotatably connected to the key cap and the base plate such that the key cap moves with the support device between a non-pressed position and a pressed position, the first support member having a receiving opening and a second magnetic area corresponding to the first magnetic area, the second magnetic area being disposed within the receiving opening;

wherein when the key cap is not pressed, a magnetic attraction force between the first magnetic area and the second magnetic area keeps the key cap at the non-pressed position; when the key cap is pressed by an external force such that the second magnetic area moves away from the first magnetic area with rotation of the first support member, the key cap moves with the support device from the non-pressed position toward the pressed position; when the external force is removed, the second magnetic area moves toward the first magnetic area due to the magnetic attraction force such that the key cap moves with the support device from the pressed position toward the non-pressed position.

2. The keyswitch of claim 1, wherein one of the first magnetic area and the second magnetic area is a magnetic object and the other one of the first magnetic area and the second magnetic area is a magnetic object or a magnetic induction material.

3. The keyswitch of claim 1, wherein the first support member further has a first connecting portion, a lower end, and a second connecting portion, the first connecting portion is connected to the base plate, the second connecting portion is connected to the key cap, the receiving opening is formed between the first connecting portion and the lower end, and when the key cap is pressed by the external force, which overcomes the magnetic attraction force, the second magnetic area pivots on the first connecting portion with the rotation of the first support member such that the second magnetic area moves away from the first magnetic area and the key cap moves with the support device from the non-pressed position to the pressed position; when the external force is removed, the first magnetic area attracts the second magnetic area magnetically and then the second magnetic area drives the support device to pivot on the first connecting portion such that the second magnetic area moves toward the first magnetic area and the key cap moves with the support device from the pressed position to the non-pressed position.

4. The keyswitch of claim 3, wherein the base plate has a connecting socket, and the first connecting portion is confined in the connecting socket such that the first connecting portion is rotatably connected to the base plate.

5. The keyswitch of claim 3, wherein the keyswitch further comprises a circuit board disposed between the base plate and the support device, the support device further comprises a linking arm, the linking arm is extended from the second magnetic area and movably disposed in the receiving opening, a downward triggering end of the linking arm extends out from the receiving opening for triggering the circuit board, and after the key cap is pressed to make the first support member and the second support member rotate such that the downward triggering end of the linking arm touches the circuit board and the second magnetic area pivots on the first connecting portion with the rotation of the first support member to move away from the first magnetic area, the second magnetic area pivots in the receiving opening to make the linking arm move upward within the receiving opening and the magnetic attraction force between the first magnetic area and the second magnetic area assists to keep the downward triggering end of the linking arm triggering the circuit board when the key cap is further pressed deeper by the external force.

6. The keyswitch of claim 1, wherein the first support member further has a first linking portion, the second support member has a second linking portion, and the first linking portion abuts against the second linking portion such that the first support member and the second support member rotate simultaneously when the key cap is pressed or the external force is removed.

* * * * *